US006007465A

United States Patent [19]

Kawamura et al.

[11] Patent Number: 6,007,465

[45] Date of Patent: Dec. 28, 1999

[54] YARN GUIDE ROLLER

[75] Inventors: Toshinori Kawamura, Osaka; Eiichi Yamamoto, Ehime; Makoto Endo, Ehime; Mikiya Takechi, Ehime; Haruki Morikawa, Shiga, all of Japan

[73] Assignee: Toray Industries, Inc., Japan

[21] Appl. No.: 09/183,514

[22] Filed: Oct. 30, 1998

Related U.S. Application Data

[62] Division of application No. 08/988,053, Dec. 10, 1997, Pat. No. 5,908,290.

[30] Foreign Application Priority Data

Dec. 16, 1996 [JP] Japan ..... 8-353586
Mar. 24, 1997 [JP] Japan ..... 9-090150

[51] Int. Cl.[6] ..... B21B 31/08

[52] U.S. Cl. ..... 492/30; 432/60

[58] Field of Search ..... 492/29, 30; 432/59, 432/60

[56] References Cited

U.S. PATENT DOCUMENTS

| | | | |
|---|---|---|---|
| 3,269,714 | 8/1966 | McKie . | |
| 3,599,306 | 8/1971 | Brafford | 492/30 |
| 4,165,964 | 8/1979 | Yonezawa et al. . | |
| 4,316,717 | 2/1982 | Thome . | |
| 4,696,642 | 9/1987 | Hatta . | |
| 4,836,774 | 6/1989 | Harada et al. . | |
| 5,816,988 | 10/1998 | Daringer et al. | 492/30 |

FOREIGN PATENT DOCUMENTS

| | | |
|---|---|---|
| 0 161 355 A1 | 11/1985 | European Pat. Off. . |
| 0 626 548 A1 | 11/1994 | European Pat. Off. . |

*Primary Examiner*—S. Thomas Hughes
*Assistant Examiner*—Marc W. Butler
*Attorney, Agent, or Firm*—Austin R. Miller

[57] ABSTRACT

A heat treatment furnace for fiber for heat-treating a fiber bundle (yarn) formed of many continuous filaments in hot gas while running the yarn. The heat treatment furnace has a plurality of heat treatment chambers provided in a furnace body. The temperature in each individual heat treatment chamber is independently adjusted to a temperature which is different from the temperatures in the other heat treatment chambers. Thereby, the heat treatment furnace can be made small and is able to heat-treat fiber efficiently.

This heat treatment furnace is useful, particularly, as a heat treatment furnace (an oxidizing heat treatment furnace, or a oxidizing furnace) for producing an oxidized fiber needed to produce a carbon fiber. A polyacrylonitrile-based fiber bundle (yarn), that is a precursor fiber bundle for producing an oxidized fiber, passes through a zigzag yarn path, and passes through the heat treatment furnaces, in each of which temperature is independently adjusted to a temperature that is different from the temperatures in the other furnaces. An oxidized fiber bundle (yarn) is thereby produced.

The zigzag yarn path in the heat treatment chambers for the oxidizing heat treatment is established by a combination of a plurality of yarn guide rollers provided outside the furnace body. Each yarn guide roller has, on its peripheral surface, a yarn guide groove for guiding a yarn. The yarn guide grooves have a specific cross-sectional shape whereby the cross-sectional shape of the yarn to be supplied into the heat treatment chambers for the oxidizing heat treatment is adjusted into a flat generally rectangular shape. Heat accumulation in the yarn being heat-treated is thereby reduced.

2 Claims, 10 Drawing Sheets

YARN GUIDE ROLLER

This application is a divisional of application Ser. No. 08/988,053, filed Dec. 10, 1997 now U.S. Pat. No. 5,908, 290, incorporated herein by reference.

BACKGROUND OF THE INVENTION

1. Field of the Invention

The present invention relates to a heat treatment furnace for fiber and, more particularly, to a heat treatment furnace (an oxidizing heat treatment furnace, an oxidizing furnace, or the like) for producing an oxidized fiber needed to produce a carbon fiber. The invention also relates to a yarn guide roller for use in the heat treatment furnace.

2. Description of the Prior Art

A horizontal-type heat treatment furnace described in Japanese examined patent application publication No. Hei 3-4832 is known as a heat treatment furnace used for an oxidizing heat treatment of a precursor fiber bundle in order to obtain an oxidized fiber bundle. The horizontal-type heat treatment furnace has a furnace body, a plurality of heat treatment chambers provided in the furnace body, a hot gas blow opening and a hot gas suction opening that are formed in each heat treatment chamber, a hot gas circulation duct to which the plurality of hot gas blow openings and the hot gas suction openings are commonly connected, a heater provided in the hot gas circulation duct, and a hot gas-circulating fan disposed downstream from the heater. That is, this conventional heat treatment furnace is a multi heat treatment chambers/common hot gas circulation duct type heat treatment furnace that circulates a hot gas and maintains a predetermined temperature of the hot gas by using the hot gas-circulating fan and the hot gas-heating heater provided in the hot gas circulation duct connecting to the hot gas blow openings and the hot gas suction openings of the heat treatment chambers.

A precursor fiber bundle (yarn) used to produce an oxidized fiber bundle for production of a carbon fiber bundle, for example, a fiber bundle (yarn) formed of a great number of polyacrylonitrile (PAN)-based continuous filaments, moves along a zigzag path, guided by a plurality of yarn guide rollers provided outside the heat treatment furnace, so that the fiber bundle sequentially passes through the heat treatment chambers. The fiber bundle receives oxidizing treatment during the passage through the heat treatment chambers. However, the heat treatment furnace has the following problems.

The oxidation of precursor fiber bundles gradually progresses. If a yarn is treated at a high temperature in an early stage of heat treatment, the yarn is likely to fire because the oxidation has not fully progressed in that stage. Therefore, it is necessary to maintain a low heat-treating temperature until the oxidation of yarn progresses to a certain extent. However, if a low temperature setting continues in a later stage of the heat treatment, a long heat treatment time is required. To secure a long heat treatment time, there arises a need to increase the furnace length or the number of passages through the furnace (that is, the number of paths in the furnace along which yarn is moved). As a result, the scale of the furnace becomes great, or the equipment cost increases, or economical production of carbon fiber bundles, which are produced by carbonizing oxidized fiber bundles, becomes difficult.

In view of these problems, the aforementioned conventional heat treatment furnace will be examined. In order to avoid firing of a precursor yarn in a heat treatment chamber into which a yarn is first introduced, a low temperature setting is needed in the first heat treatment chamber of a heat treatment furnace. However, since the conventional heat treatment furnace is a multi heat treatment chambers/common hot gas circulation duct type heat treatment furnace, the temperatures in the heat treatment chambers succeeding to the first heat treatment chamber inevitably become equal to the temperature in the first heat treatment chamber. Therefore, the heat treatment time for precursor yarns (the length of time during which a yarn is treated in the heat treatment chambers) inevitably becomes long in the conventional heat treatment furnace, thereby causing problems of increased length and scale of the heat treatment furnace and, therefore, increased equipment and production costs.

Furthermore, in order to vary the heat treatment temperature in accordance with the progress of oxidation of a precursor yarn in the conventional heat treatment furnace, it is necessary to use a plurality of heat treatment furnaces that differ in heat treatment temperature. However, this requirement increases the equipment installation space, the equipment cost and, therefore, the production cost of carbon fibers.

A known yarn guide roller as described above is described in Japanese examined patent application publication Sho 59-28662. This yarn guide roller has a guide groove that is formed on a peripheral surface of the roller for guiding a yarn. The groove forms a circular sectional shape of the yarn that is introduced into the heat treatment chambers. However, as the denier or the number of filaments of a yarn guided by the groove, the maximum yarn thickness increases and, therefore, yarn heat accumulation increases, so that breakage of a filament constituting the yarn becomes more likely due to the heat accumulation.

In order to avoid such an increase in the likelihood of filament breakage, it is necessary to perform oxidizing treatment at a lower temperature. Therefore, if the aforementioned yarn guide roller is used, it takes an inconveniently long time to produce a sufficiently oxidized fiber.

Furthermore, since the groove of the yarn guide roller shapes the sectional shape of a yarn into a circular shape, diffusion of oxygen, which is required for the yarn oxidation, into an interior of the yarn (filaments present inside the yarn) becomes less easy to occur. As a result, the degree of oxidation progress considerably differs between an interior portion (filaments present inside) of the yarn and a surface portion (filaments adjacent to the yarn surface) of the yarn. Such a oxidation progress difference in interior and surface portions of the yarn can become a cause for fuzzing or a damage of a filament in a later-performed carbonizing process. The conventional yarn guide roller has problems as described above.

SUMMARY OF THE INVENTION

Accordingly, it is an object of the present invention to provide a heat treatment furnace for fiber and, more particularly, a heat treatment furnace suitable for use in production of oxidized fiber bundles (yarns) that are used to produce carbon fiber bundles, that is, a heat treatment furnace suitable for oxidizing treatment of a precursor fiber bundle (yarn) of an oxidized fiber bundle (yarn), which furnace varies the heat treatment temperature in accordance with the progress of heat treatment so as to efficiently perform the heat treatment in a short time, without increasing the heat treatment furnace scale and without requiring installation of many heat treatment furnaces.

It is another object of the invention to provide a heat treatment furnace that employs a yarn guide roller for adjustment of the sectional shape of a yarn subjected to the oxidizing treatment into a specific shape such that the difference in progress of the oxidation between an inner layer and an outer layer of the yarn becomes as small as possible if the yarn subjected to oxidation has a great denier or a great number of filaments.

To achieve the aforementioned objects, one aspect of the invention provides a heat treatment furnace for fiber, including: (a) a furnace body; (b) a plurality of heat treatment chambers provided in the furnace body, through which chambers a yarn formed of a plurality of continuous filaments sequentially passes while being run, (c) each heat treatment chamber having at one end thereof a yarn inlet and at another end thereof a yarn outlet being formed at a position opposite to the position of the yarn inlet, a hot gas leading-in chamber provided at an end portion within each heat treatment chamber, and a hot gas leading-out chamber provided at another end portion within each heat treatment chamber; (d) a hot gas blow opening formed in each hot gas leading-in chamber and which is directed toward an interior of the heat treatment chamber, for blowing hot gas in a direction along a running passage of the yarn; (e) a hot gas suction opening formed in each hot gas leading-out chamber and which is formed at a position facing the hot gas blow opening; and (f) temperature adjustment means provided in the furnace, for enabling adjustment of temperature in at least two heat treatment chambers of the plurality of heat treatment chambers to different values independent of each other.

The heat treatment furnace for fiber of the invention may further have a construction wherein the temperature adjustment means includes: (a) a first hot gas circulation duct connecting the hot gas leading-out chamber of one heat treatment chamber of the at least two heat treatment chambers to the hot gas leading-in chamber of the one heat treatment chamber; (b) a first hot gas circulating fan provided in the first hot gas circulation duct; (c) a first hot gas temperature adjusting heater provided in the first hot gas circulation duct; (d) a second hot gas circulation duct connecting the hot gas leading-out chamber of at least one heat treatment chamber of the at least two heat treatment chambers to the hot gas leading-in chamber of the at least one heat treatment chamber, the at least one heat treatment chamber being different from the one heat treatment chamber connected to the first hot gas circulation duct wherein the second hot gas circulation duct is independent of the first hot gas circulation duct; (e) a second hot gas circulating fan provided in the second hot gas circulation duct; and (f) a second hot gas temperature adjusting heater provided in the second hot gas circulation duct.

Although the heat treatment furnace for fiber of the invention can be constructed as a so-called vertical furnace, it is preferable that the heat treatment furnace of the invention be constructed as a horizontal furnace wherein a plurality of heat treatment chambers are vertically arranged in such a manner that a running yarn passes substantially in horizontal direction through the heat treatment chambers.

Therefore, in the heat treatment furnace for fiber of the invention, the heat treatment chambers may be sequentially disposed in a vertical arrangement such that a straight line passing though the yarn inlet and the yarn outlet of each heat treatment chamber becomes substantially horizontal.

The heat treatment furnace for fiber of the invention can be used as an oxidizing furnace. In such a use, it is preferable that a set temperature in a heat treatment chamber disposed downstream in the yarn running direction, that is, a later-stage heat treatment chamber, be higher than the set temperature in an earlier-stage heat treatment furnace.

Therefore, in the heat treatment furnace for fiber of the invention, the temperature adjustment means may include means for adjusting a temperature in a heat treatment chamber disposed in one stage in a yarn-passing sequence of the heat treatment chambers to a temperature lower than a temperature in another heat treatment chamber disposed in another stage that is later than the one stage.

The temperature adjustment means may further include means for adjusting a temperature in each heat treatment chamber to a temperature suitable for oxidization of the yarn passing through the heat treatment chamber.

When the heat treatment furnace for fiber of the invention runs a yarn and therefore introduces the yarn into the heat treatment chambers through their yarn inlets, the yarn drags external air thereinto. The heat treatment temperature is thereby reduced. It is preferable to prevent such a temperature reduction.

Therefore, in the heat treatment furnace for fiber of the invention, at least one of the heat treatment chambers may have a temperature increasing chamber that is provided between the yarn inlet and the hot gas leading-in chamber, for increasing a temperature of external air that flows in through the yarn inlet.

It is also preferable that an area of a heat treatment chamber and an area of the hot gas blow opening of the heat treatment chamber in a plane perpendicular to the yarn passage have a specific relationship.

Therefore, in at least one heat treatment chamber of the heat treatment chambers of the heat treatment furnace for fiber of the invention, an inside area Sf of the hot gas blow opening in a plane substantially perpendicular to a running passage of the yarn in the heat treatment chamber and an inside area Ss of the heat treatment chamber in the plane substantially perpendicular to a running passage of the yarn in the heat treatment chamber satisfy the following relational expression: $Ss/Sf \leqq 2$.

It is also preferable that the speed of hot gas blow out of the hot gas blow opening satisfy a specific condition.

Therefore, the heat treatment furnace for fiber of the invention may further include means for adjusting hot gas blown out of the hot gas blow opening so that a ratio $V_1/V_2$ between a maximum flow speed $V_1$ of hot gas at the hot gas blow opening and a maximum flow speed $V_2$ at a position 1 m apart from the hot gas blow opening in a direction substantially parallel to the running passage of the yarn becomes at most 1.1.

When an oxidized fiber bundle is produced using the heat treatment furnace for fiber of the invention, it is preferable that a precursor yarn to be introduced into the heat treatment chambers have a flat cross-sectional shape that is formed before the introduction into the heat treatment chambers, in view of prevention of heat accumulation and acceleration of heat removal. To form such a cross-sectional shape of a yarn before it is introduced into the heat treatment chambers, it is preferable that a yarn guide roller as described below be provided. It is also preferable that the heat treatment furnace for fiber of the invention further includes the yarn guide roller.

That is, another aspect of the invention provides a yarn guide roller including a yarn guide groove formed on a peripheral surface of the yarn guide roller, the guide groove having a width Wa at a top portion of the groove, a width Wb at a bottom portion of the groove, a depth h of the groove, and a radius R of a roundish bottom corner portion of the groove, which satisfy the following three relational expressions:

$$0.7 \leqq Wb/Wa < 1 \quad \text{(I)}$$

$$0.2 \times Wa \leqq h \leqq 0.4 \times Wa \quad \text{(II)}$$

$$0.2 \times (Wa - Wb) \leqq R \leqq 0.4 \times (Wa - Wb) \quad \text{(III)}$$

the yarn guide roller being disposed outside a furnace body of a heat treatment furnace for fiber and guiding a yarn that is being introduced into the furnace body, by the yarn guide groove.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DESCRIPTION OF THE PREFERRED EMBODIMENTS

Preferred embodiments of the heat treatment furnace of the invention will be described in detail hereinafter with reference to the accompanying drawings.

The heat treatment furnace for fiber of the invention may be suitably used as a heat treatment furnace for fiber in a carbon fiber production process, that is, an oxidizing furnace or a carbonizing furnace. It is particularly suitable as an oxidizing furnace. Embodiments and examples will be described below, in conjunction with a case wherein the heat treatment furnace for fiber of the invention is used in a production process of carbon fibers and, particularly, in conjunction with a case wherein the heat treatment furnace for fiber of the invention is used as an oxidizing furnace.

A precursor fiber bundle (hereinafter, a fiber bundle is referred to as "yarn") formed of an assembly of many continuous polyacrylonitrile-based filaments is contained in a can and thus prepared in a carbon fiber production plant. The precursor yarn is drawn out of the can and supplied into an oxidizing furnace, where the precursor yarn is subjected to an oxidizing treatment. In the oxidizing treatment, the precursor yarn is heated at temperatures of 200° C.–350° C. in an oxidative atmosphere. The precursor yarn, when oxidation-treated, becomes an oxidized yarn. The oxidized yarn is supplied into a carbonizing furnace, where the yarn is subjected to a carbonizing treatment. In the carbonizing treatment, the oxidized yarn is heated at temperatures of 500° C.–1500° C. in an inactive atmosphere. The oxidized yarn, when carbonized, becomes a carbonized yarn (carbon fiber). After the carbonized yarn receives surface treatment, such as addition of an sizing agent, if necessary, the carbonized yarn is wound up on a bobbin in a winding process. A package (product) of the carbonized yarn (carbon fiber) is thus produced.

The construction related to heat treatment temperature control of the oxidizing furnace and the construction related to prevention of leakage of hot gas will be described.

Figure 1:
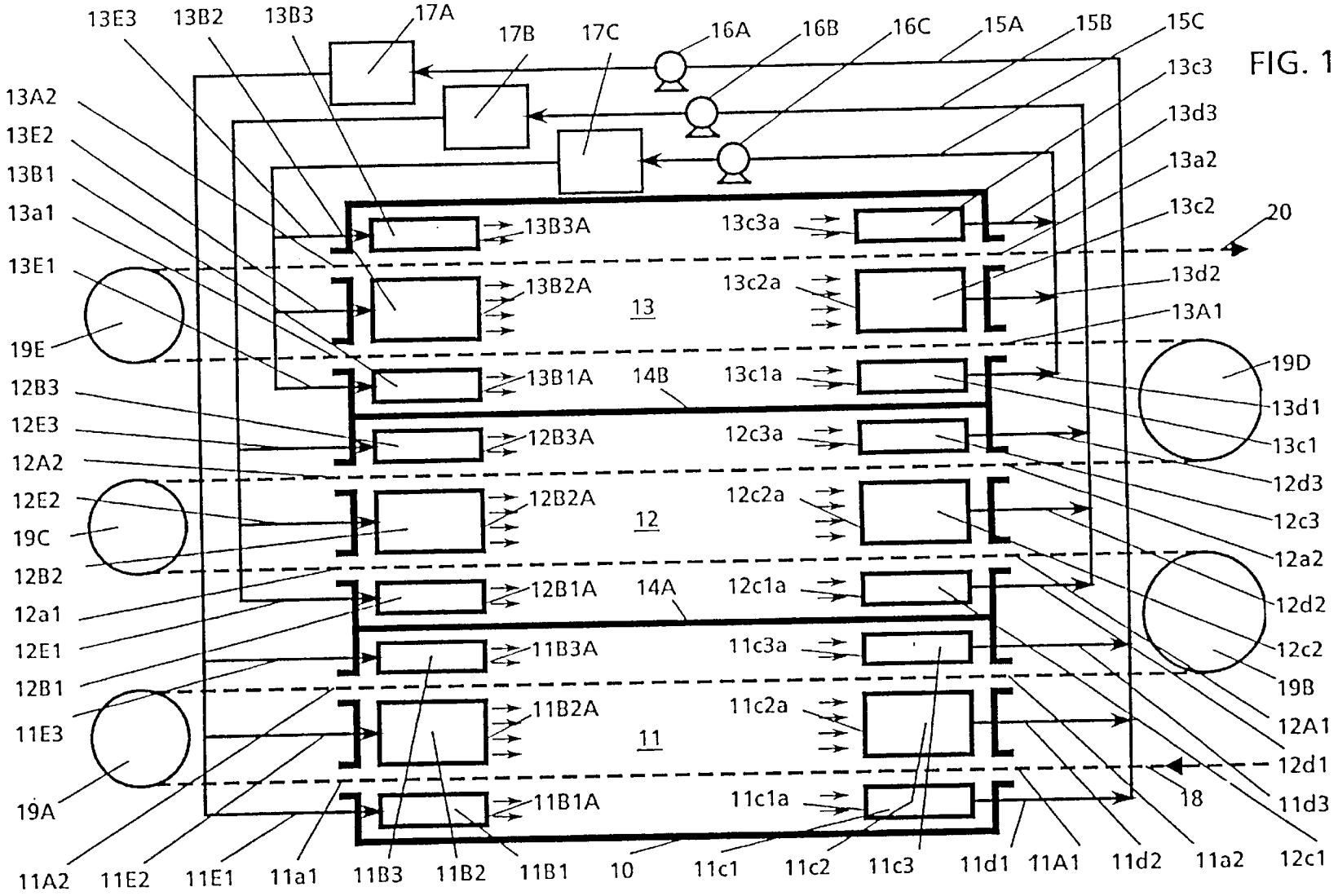
FIG. 1 is a longitudinal sectional schematic view of an embodiment of the heat treatment furnace for fiber of the invention.

FIG. 1 is a longitudinal sectional schematic view of an embodiment of the heat treatment furnace for fiber of the invention.

Referring to FIG. 1, a furnace body 10 has three horizontally-directed heat treatment chambers, that is, a first heat treatment chamber 11, a second heat treatment chamber 12 and a third heat treatment chamber 13. The furnace body 10 thus forms a horizontal heat treatment furnace. Partition walls 14A, 14B are provided between the first heat treatment chamber 11 and the second heat treatment chamber 12, and between the second heat treatment chamber 12 and the third heat treatment chamber 13, respectively. Due to the partition walls 14A, 14B, the heat treatment chambers 11, 12 and 13 are independent of one another in the furnace body 10.

The first heat treatment chamber 11 has a first yarn inlet 11A1 at a right-hand end portion. A second yarn outlet 11*a*2 is provided above the first yarn inlet 11A1. At a left side end portion of the first heat treatment chamber 11, a first yarn outlet 11*a*1 is provided. A second yarn inlet 11A2 is provided above the first yarn outlet 11*a*1.

The first yarn inlet 11A1 and the first yarn outlet 11*a*1 are directed substantially horizontally, and face each other. Likewise, the second yarn inlet 11A2 and the second yarn outlet 11*a*2 are directed substantially horizontally, and face each other.

The first heat treatment chamber 11 further has, at a left end portion in its interior, hot gas leading-in chambers 11B1, 11B2, 11B3 and, at a right end portion in the interior, hot gas leading-out chambers 11*c*1, 11*c*2, 11*c*3.

A clearance between an upper surface of the hot gas leading-out chamber 11*c*1 and a lower surface of the hot gas leading-out chamber 11*c*2 corresponds to the first yarn inlet 11A1. A clearance between an upper surface of the hot gas leading-in chamber 11B1 and a lower surface of the hot gas leading-in chamber 11B2 corresponds to the first yarn outlet 11*a*1. A clearance between an upper surface of the hot gas leading-in chamber 11B2 and a lower surface of the hot gas leading-in chamber 11B3 corresponds to the second yam inlet 11A2. A clearance between an upper surface of the hot gas leading-out chamber 11*c*2 and a lower surface of the hot gas leading-out chamber 11*c*3 corresponds to the second yarn outlet 11*a*2.

The first heat treatment chamber 11 is constructed as described above. The other heat treatment chambers, that is, the second heat treatment chamber 12 and the third heat treatment chamber 13, have substantially the same constructions as the first heat treatment chamber 11. The elements of the second heat treatment chamber 12 and the third heat treatment chamber 13 comparable to those of the first heat treatment chamber 11 are represented in FIG. 1 by reference characters combining 12 or 13 with the same character and numeral suffixes used for the corresponding elements of the first heat treatment chamber 11, and will not be described again.

The first, second and third heat treatment chambers 11, 12, 13 separately provided in the furnace body 10 have separate hot gas circulation ducts.

Specifically, the hot gas leading-out chambers 11*c*1, 11*c*2, 11*c*3 are connected to hot gas outlet branch ducts 11*d*1, 11*d*2, 11*d*3. The other end of each of the hot gas outlet branch ducts 11*d*1, 11*d*2, 11*d*3 is connected to a circulation duct 15A. The hot gas leading-in chambers 11B1, 11B2, 11B3 are connected to hot gas inlet branch ducts 11E1, 11E2, 11E3. The other end of each of the hot gas-inlet branch ducts 11E1, 11E2, 11E3 is connected to the circulation duct 15A.

A hot gas circulating fan 16A is mounted in part way of the circulation duct 15A. A hot gas temperature adjusting heater 17A is mounted downstream from hot gas circulating fan 16A. The hot gas output branch ducts 11*d*1, 11*d*2, 11*d*3, the circulation duct 15A and hot gas inlet branch ducts 11E1, 11E2, 11E3 constitute a first hot gas circulation duct for the first heat treatment chamber 11.

The first hot gas circulating duct for the first heat treatment chamber 11 is constructed as described above. Second and third hot gas circulating ducts for the second heat treatment chamber 12 and the third heat treatment chamber 13 have substantially the same constructions as the first hot gas circulation duct for the first heat treatment chamber 11. The elements of the second hot gas circulation duct and the third hot gas circulation duct comparable to those of the first hot gas circulation duct are represented in FIG. 1 by reference characters corresponding to the reference characters for the corresponding elements of the first hot gas circulation duct, and will not be described again.

A precursor yarn 18 to be subjected to oxidizing treatment in the furnace body 10 is first introduced into the first heat treatment chamber 11 from the first yarn inlet 1A11. Subsequently, the precursor yarn 18 passes sequentially through the first heat treatment chamber 11, the second heat treatment chamber 12 and the third heat treatment chamber 13 in a zigzag manner. To establish the zigzag path, yarn guide rollers are disposed outward from the right and left sides of the furnace body 10.

Specifically, a guide roller 19A is provided corresponding to the first yarn outlet 11*a*1 and the second yarn inlet 11A2 of the first heat treatment chamber 11. A guide roller 19B is provided corresponding to the second yarn outlet 11*a*2 of the first heat treatment chamber 11 and the first yarn input opening 12A1 of the second heat treatment chamber 12. A guide roller 19C is provided corresponding to the first yarn outlet 12*a*1 and the second yarn inlet 12A2 of the second heat treatment chamber 12. A guide roller 19D is provided corresponding to the second yarn outlet 12*a*2 of the second heat treatment chamber 12 and the first yarn input opening 13A1 of the third heat treatment chamber 13. A guide roller 19E is provided corresponding to the first yarn outlet 13*a*1 and the second yarn inlet 13A2 of the third heat treatment chamber 13.

Guided by the yarn guide rollers, the precursor yarn 18 to be subjected to oxidizing treatment enters the furnace body 10 from the first yarn inlet 11A1 of the first heat treatment chamber 11, and passes through the first heat treatment chamber 11, and temporarily goes out of the first yarn outlet 11*a*1 to the outside of the furnace body 10. Then, the precursor yarn 18 goes around substantially a half of the circumference of yarn guide roller 19A, that is, the moving direction is reversed by the yarn guide roller 19A. The precursor yarn 18 re-enters the furnace body 10 from the second yarn inlet 11A2, passes through the first heat treatment chamber 11, and goes out of the second yarn outlet 11*a*2 to the outside of the furnace body 10.

The yarn, led out from the first heat treatment chamber 11 and, therefore, oxidized to a certain extent, is reversed in moving direction by the yarn guide roller 19B, and enters the furnace body 10 from the first yarn inlet 12A1 of the second heat treatment chamber 12, and passes through the second heat treatment chamber 12. Similar to the path in conjunction with first heat treatment chamber 11, the yarn is guided by the yarn guide rollers 19C, 19D, 19E to go out of the furnace body 10 through the second yarn outlet 13*a*2 of third heat treatment chamber 13. The yarn led out of the furnace body 10 has been subjected to a desired oxidizing treatment, that is, has become an oxidized yarn 20. The oxidized yarn 20 runs to a heat treatment furnace for carbonizing treatment (not shown).

The oxidizing treatment in the heat treatment chambers 11, 12, 13 is performed in a hot oxidative gas (normally, in hot air). The temperature in the heat treatment chambers 11, 12, 13 are separately controlled at predetermined temperatures by hot gas (heated air) circulated through the circulation ducts 15A, 15B, 15C. The temperature control will be described in detail in conjunction with the first heat treatment chamber 11.

The heated air in the first heat treatment chamber 11 is drawn into the three hot gas leading-out chambers 11*c*1, 11*c*2, 11*c*3 through hot gas suction openings 11*c*1*a*, 11*c*2*a*, 11*c*3*a* formed in left end surfaces of the hot gas leading-out chambers 11*c*1, 11*c*2, 11*c*3. After being drawn into the hot gas leading-out chambers 11*c*1, 11*c*2, 11*c*3, heated air flows through the hot air outlet branch ducts 11*d*1, 11*d*2, 11*d*3 and then through the circulation duct 15A. In the circulation duct 15A, heated air passes the heat gas circulating fan 16A and the heat gas temperature adjusting heater 17A provided in part way of the circulation duct 15A. Heated air then passes the hot gas inlet branch ducts 11E1, 11E2, 11E3, and flows into the three hot air inlet chambers 11B1, 11B2, 11B3. Heated air is then blown into the first heat treatment chamber 11 in a direction substantially parallel to the yarn paths in the first heat treatment chamber 11, from hot air blow openings 11B1A, 11B2A, 11B3A formed in right end surfaces of the hot air inlet chambers 11B1, 11B2, 11B3.

The hot gas circulation is caused by the heat gas circulating fan 16A provided in the circulation duct 15A. Adjustment of the oxidizing treatment temperature in the first heat treatment chamber 11 is performed by the heat gas temperature adjusting heater 17A adjusting the temperature of heated air circulating through the circulation duct 15A.

The circulation and temperature adjustment of heated air for the second heat treatment chamber 12 and the third heat treatment chamber 13 are performed by the circulation duct 15B, the heat gas circulating fan 16B and the heat gas temperature adjusting heater 17B, and the circulation duct 15C, the heat gas circulating fan 16C and the heat gas temperature adjusting heater 17C, respectively, in the same manner as the circulation and temperature adjustment of heated air for the first heat treatment chamber.

In each of the hot gas circulating systems for the heat treatment chambers 11, 12, 13, a portion of the heated gas (heated air) is discharged out of the system and replenishing gas (air) is introduced at certain locations in the circulation system, if necessary.

Although the heat treatment furnace of this embodiment has only one furnace body 10, the heat treatment temperature in the heat treatment chambers 11, 12, 13 provided therein is controlled separately for the individual heat treatment chambers 11, 12, 13, so that different temperatures can be set for the individual heat treatment chambers 11, 12, 13.

Normally, oxidizing treatment is performed within the temperature range of 200–350° C. As stated above, oxidation gradually progresses. There is a danger that high-temperature heat treatment to a yarn in an earlier stage of oxidation may cause to the yarn to fire. Furthermore, low-temperature heat treatment in a later stage of oxidation will result in an inconveniently long time for completion of the oxidation.

However, since the fiber heat treatment race of this embodiment makes it possible to gradually increase the oxidizing treatment temperature in accordance with the progress of oxidation, it is possible to avoid the firing of a yarn in an earlier stage of oxidation and to increase the processing speed in later stages. In the three-stage heat treatment employing three heat treatment chambers 11, 12, 13, the temperature in the first stage, that is, the first heat treatment chamber 11, is set to 210° C.±10° C., and the temperature in the second stage, that is, the second heat treatment chamber 12, is set to 220° C.±10° C., and the temperature in the third stage, that is, the third heat treatment chamber 13, is set to 240° C.±10° C., in such a manner that a higher temperature is set in a later stage. Thereby, the heat treatment furnace of this embodiment is able to achieve a desired oxidizing treatment in a shorter time than the conventional heat treatment furnaces. Furthermore, the heat treatment furnace of this embodiment is smaller in scale than the conventional heat treatment furnaces. As a result, the production cost of carbon fibers can be reduced.

The number of heat treatment chambers is at least two. It is preferred that a heat treatment furnace for production of an oxidized fiber to be used to produce a carbon fiber employ 3 or 4 heat treatment chambers. In the heat treatment furnace shown in FIG. 1, each yarn inlet (for example, the first yarn inlet 11A1) has a slit shape extending in the direction of width of the right and left side surfaces of the furnace body 10 (see a yarn inlet 12A1, a yarn outlet **12*a*2 shown in FIG. 9, and yarn guide rollers shown in FIG. 13**), so that a plurality of yarns running at predetermined clearances can be simultaneously received.

The treatment time in the individual heat treatment chambers is not necessarily the same. For example, the treatment time (the length of time during which a yarn remains in the heat treatment chamber) in the heat treatment chambers may be set to 5–10 minutes for the first stage (first heat treatment chamber), the 5–10 minutes for the second stage, and 10–20 minutes for the third stage, or in such proportions. Such treatment time settings that differ for the heat treatment chambers can be achieved by varying the number of turns of the yarn path in the individual heat treatment chambers, that is, the number of yarn passages through the individual heat treatment chambers.

Figure 2:
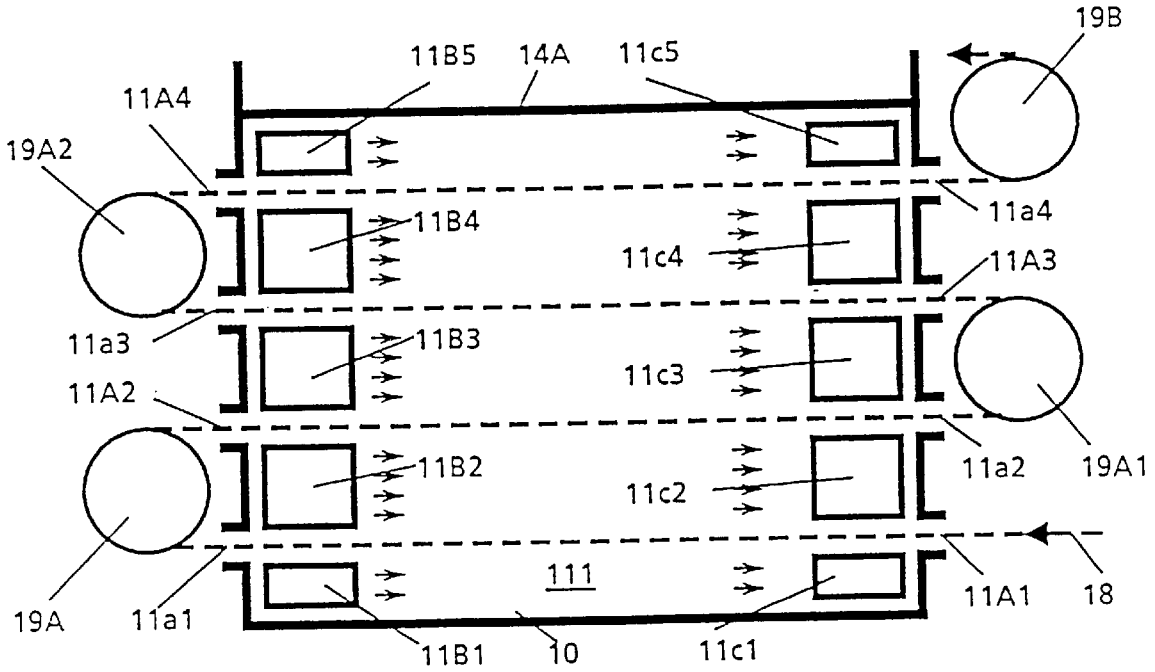
FIG. 2 is a schematic longitudinal view of a modification of one of the heat treatment chambers of the heat treatment furnace for fiber shown in FIG. 1.

A specific example is shown in FIG. 2. FIG. 2 is a schematic longitudinal view of a modification of the first heat treatment chamber shown in FIG. 1.

Referring to FIG. 2, a first heat treatment chamber 111 of a furnace body 10 is separated by a partition wall 14A as in the embodiment shown in FIG. 1.

The first heat treatment chamber 111 has a first yarn inlet 11A1 at a right-hand end portion. A second yarn outlet **11*a*2, a third yarn inlet 11A3 and a fourth yarn outlet 11*a*4 are provided above the first yarn inlet 11A1. At a left side end portion of the first heat treatment chamber 111, a first yarn outlet 11*a*1 is provided. A second yarn inlet 11A2, a third yarn outlet 11*a*3 and a fourth yarn inlet 11A4 are provided above the first yarn outlet 11*a*1**.

The first yarn inlet 11A1 and the first yarn outlet **11*a*1 are directed substantially horizontally, and face each other. Likewise, the second yarn inlet 11A2 and the second yarn outlet 11*a*2 are directed substantially horizontally, and face each other, and the third yarn inlet 11A3 and the third yarn outlet 11*a*3, and the fourth yarn inlet 11A4 and the fourth yarn outlet 11*a*4** are directed substantially horizontally, and face each other.

The first heat treatment chamber 111 further has, at a left end portion in its interior, hot gas leading-in chambers 11B1, 11B2, 11B3, 11B4, 11B5 and, at a right end portion in the interior, hot gas leading-out chambers **11*c*1, 11*c*2, 11*c*3, 11*c*4, 11*c*5**.

A clearance between an upper surface of the hot gas leading-out chamber **11*c*1 and a lower surface of the hot gas leading-out chamber 11*c*2 corresponds to the first yarn inlet 11A1. A clearance between an upper surface of the hot gas leading-in chamber 11B1 and a lower surface of the hot gas leading-in chamber 11B2 corresponds to the first yarn outlet 11*a*1**.

A clearance between an upper surface of the hot gas leading-in chamber 11B2 and a lower surface of the hot gas leading-in chamber 11B3 corresponds to the second yarn inlet 11A2. A clearance between an upper surface of the hot gas leading-out chamber **11*c*2 and a lower surface of the hot gas leading-out chamber 11*c*3 corresponds to the second yarn outlet 11*a*2**.

A clearance between an upper surface of the hot gas leading-out chamber **11*c*3 and a lower surface of the hot gas leading-out chamber 11*c*4 corresponds to the first yarn inlet 11A3. A clearance between an upper surface of the hot gas leading-in chamber 11B3 and a lower surface of the hot gas leading-in chamber 11B4 corresponds to the first yarn outlet 11*a*3**.

A clearance between an upper surface of the hot gas leading-in chamber 11B4 and a lower surface of the hot gas leading-in chamber 11B5 corresponds to the second yarn inlet 11A4. A clearance between an upper surface of the hot gas leading-out chamber **11*c*4 and a lower surface of the hot gas leading-out chamber 11*c*5 corresponds to the second yarn outlet 11*a*4**.

The hot gas leading-out chambers **11*c*1–11*c*5 are connected to hot gas outlet branch ducts as in the embodiment shown in FIG. 1. The hot gas outlet branch ducts are connected to a circulation duct 15A (not shown in FIG. 2) as shown in FIG. 1. The hot gas leading-in chambers 11B1–1B5 are connected to hot gas inlet branch ducts as in the embodiment shown in FIG. 1. The hot gas inlet branch ducts are connected to the circulation duct 15A**.

A hot gas suction opening is formed in a left end portion of each of the hot gas leading-out chambers **11*c*1–11*c*5, and a hot gas blow opening is formed in a right end portion of each of the hot gas leading-in chambers 11B1–11B5 (not shown in FIG. 2), as in the embodiment shown in FIG. 1**.

The first heat treatment chamber 111 shown in FIG. 2 and the first heat treatment chamber 11 shown in FIG. 1 are distinguished from each other in that the first heat treatment chamber 11 shown in FIG. 1 has two yarn passages arranged respectively in vertical direction whereas the first heat treatment chamber 111 shown in FIG. 2 has four yarn passages arranged respectively in vertical direction that are established by yarn guide rollers 19A, 19A1, 19A2, 19B. If the yarn running speed is the same, the yarn heat treatment time is longer in the first heat treatment chamber 111 shown in FIG. 2 than in the first heat treatment chamber 11 shown in FIG. 1.

If the heat treatment furnace shown in FIG. 1 employs the first heat treatment chamber 111 shown in FIG. 2 in place of the first heat treatment chamber 11 shown in FIG. 1, the heat treatment time in the first stage heat treatment chamber becomes longer than the heat treatment time in the later stage heat treatment chambers.

The yarn running speed in the heat treatment furnace may be determined in accordance with the yarn thickness, the oxidation progressing rate, and the like. However, for sufficient and reliable progress of oxidizing treatment, it is preferred to set a yarn running speed such that the treatment time per path in each heat treatment chamber becomes at least 3 minutes.

The embodiment of the heat treatment furnace of the invention illustrated with reference to FIGS. 1 and 2 is a type of furnace wherein a yarn passes through a heat treatment chamber in forward and backward direction so that the yarn running direction on the forward or backward path opposes the direction of flow of hot gas.

In heat treatment of fiber, there is a possibility that the incidence of fuzzing or filament breakage during heat treatment less in a case where the yarn running direction is the same as the hot gas flowing direction in a heat treatment chamber than in a case where the yarn running direction is opposite to the hot gas flowing direction. For heat treatment of a yarn with such a tendency, the first heat treatment chamber 11 of the heat treatment face shown in FIG. 1 may be modified so that the yarn 18 passes through the first heat treatment chamber 11 only once, and the heated gas (heated air) blowing direction in the first heat treatment chamber 11 is the same as the yarn running direction of the first heat treatment chamber 11. A heat treatment chamber modified in this manner is shown in FIG. 3.

Figure 3:
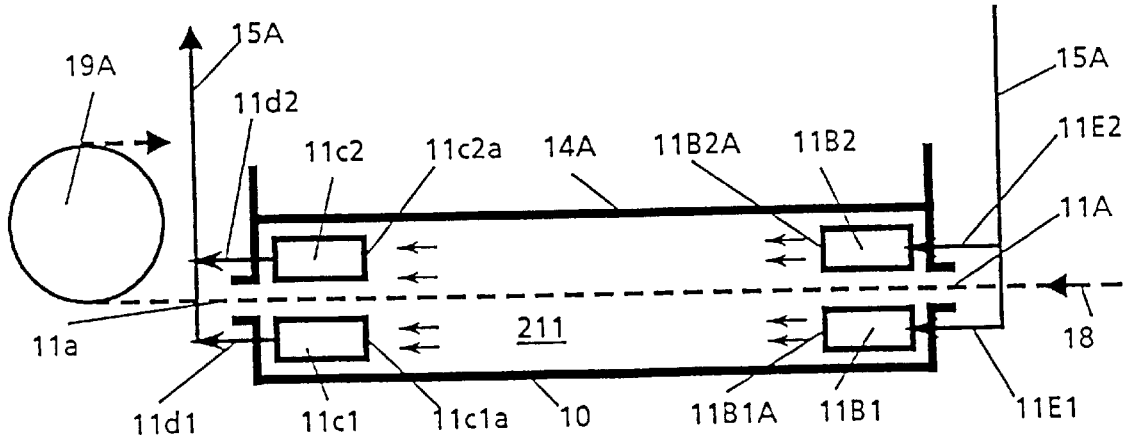
FIG. 3 is a schematic longitudinal view of another modification of one of the heat treatment chambers of the heat treatment furnace for fiber shown in FIG. 1.

FIG. 3 is a schematic longitudinal view of another modification of one of the heat treatment chambers of the heat treatment furnace for fiber shown in FIG. 1. Referring to FIG. 3, a first heat treatment chamber 211 in a furnace body 10 is separated from the next stage heat treatment chamber by a partition wall 14A. The first heat treatment chamber 211 has a yarn inlet 11A at its right end, and a yarn outlet 11a at the left end. The yarn inlet 11A and the yarn outlet **11*a*** are substantially horizontal, and face each other.

The first heat treatment chamber 211 has, at a right end portion in its interior, hot gas leading-in chambers 11B1, 11B2 and, at a left end portion in the interior, hot gas leading-out chambers **11*c*1, 11*c*2**.

A clearance between an upper surface of the hot gas leading-in chamber 11B1 and a lower surface of the hot gas leading-in chamber 11B2 corresponds to the first yarn inlet 11A1. A clearance between an upper surface of the hot gas leading-out chamber **11*c*1 and a lower surface of the hot gas leading-out chamber 11*c*2 corresponds to the first yarn outlet 11*a*1**.

The hot gas leading-out chambers **11*c*1, 11*c*2 are connected to hot gas outlet branch ducts 11*d*1, 11*d*2. The other end of each of the hot gas outlet branch ducts 11*d*11, 11*d*2 is connected to a circulation duct 15A. The hot gas leading-in chambers 11B1, 11B2 are connected to hot gas inlet branch ducts 11E1, 11E2. The other end of each of the hot gas inlet branch ducts 11E1, 11E2 is connected to the circulation duct 15A**.

A heat gas circulating fan 16A (not shown in FIG. 3) and a heat gas temperature adjusting heater 17A (not shown) are provided in part way of the circulation duct 15A as in the embodiment shown in FIG. 1.

A yarn 18 is introduced into the first heat treatment chamber 211 through the yarn inlet 11A and let out from the yarn outlet **11*a*. Via a yarn guide roller 19A provided outward from the left side of the furnace body 10, the yarn 18 is introduced into another heat treatment chamber provided above the first heat treatment chamber 211, for example, the second heat treatment chamber 12 shown in FIG. 1**.

Heat treatment of a fiber in the first heat treatment chamber 211 is performed in a heated gas. The temperature in the first heat treatment chamber 211 is controlled at a predetermined temperature by circulation of hot gas (heated gas). Heated air is drawn from the first heat treatment chamber 211 into the hot air outlet chambers **11*c*1, 11*c*2 disposed below and above a single yarn passage, through hot gas suction openings 11*c*1*a*, 11*c*2*a* formed in right side end surfaces of the hot air inlet chambers 11*c*1, 11*c*2. Heated air thus drawn into the hot air outlet chambers 11*c*1, 11*c*2 passes through the hot air outlet branch ducts 11*d*1, 11d2 and flows through the circulation duct 15A. During passage through the circulation duct 15A, hot gas passes the heat gas circulating fan 16A and the heat gas temperature adjusting heater 17A. Heated air flowing through the circulation duct 15A passes through the hot air inlet branch ducts 11E1, 11E2 and flows into the hot air inlet chambers 11B1, 11B2. Heated air is then blown into the heat treatment chamber 211 in a direction substantially parallel to the yarn passage in the heat treatment chamber 211, from hot air blow openings 11B1A, 11B2A, formed in right end surfaces of the hot air inlet chambers 11B1, 11B2**.

The hot gas circulation is caused by the heat gas circulating fan 16A (not shown in FIG. 3, see FIG. 1) provided in the circulation duct 15A. Adjustment of the heat treatment temperature in the heat treatment chamber 211 is performed by the heat gas temperature adjusting heater 17A (not shown in FIG. 3, see FIG. 1) adjusting the temperature of heated air circulating through the circulation duct 15A. The hot gas circulation and the temperature adjustment are performed in the same manner as in the example shown in FIG. 1.

In the heat treatment furnace according to the invention as shown in FIG. 3, the hot gas (heated gas) blowing direction and the yarn running direction are the same in the first heat treatment chamber 211. Therefore, the heat treatment furnace reduces the incidence of fuzzing or filament breakage which may occur depending on the characteristics of yarns treated with heat. If a heat treatment surface having a heat treatment chamber as described above is used to oxidizing treatment, the oxidizing treatment may be more uniformly performed.

Since the number of passages of a yarn through the first heat treatment chamber 211 is inevitably one, a heat treatment furnace employing a plurality of such heat treatment chambers requires a relatively large number of heat treatment chambers.

In order to perform high-precision temperature control of heated gas (heated air) in heat treatment chambers as described above, or to reduce the running cost of the heat treatment furnace and therefore reduce the production cost of a heat-treated fiber (a carbon fiber), it is preferred to provide measures for preventing leakage of hot gas from the heat treatment chambers, or for preventing entrance of external air into the heat treatment chambers. A heat treatment furnace according to the invention wherein such measures are provided will be described below.

Figure 4:
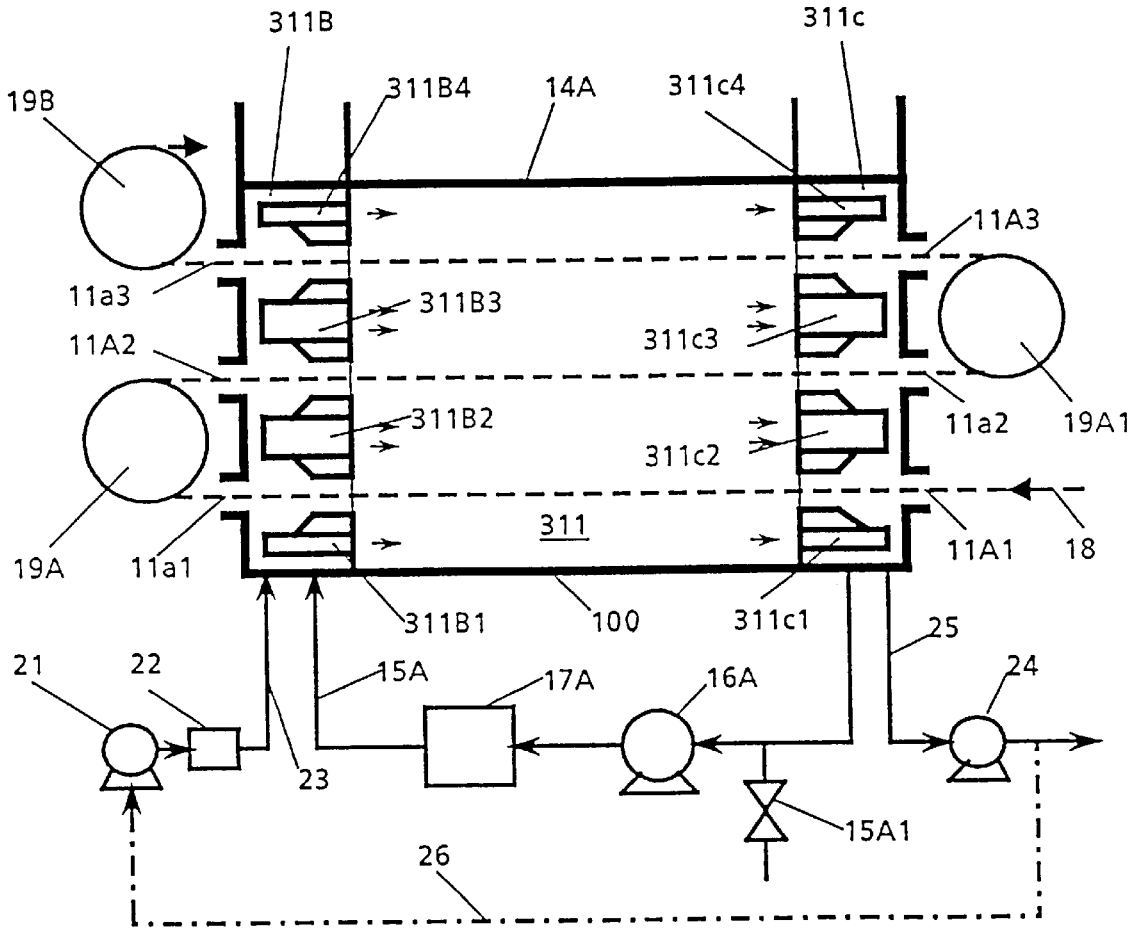
FIG. 4 is a schematic longitudinal view of still another modification of one of the heat treatment chambers of the heat treatment furnace for fiber shown in FIG. 1.

FIG. 4 is a schematic longitudinal sectional view of another embodiment of the heat treatment furnace of the invention. In the heat treatment furnace shown in FIG. 4, although a furnace body 100 has three heat treatment chambers arranged vertically, only one of the heat treatment chambers, that is, a first heat treatment chamber 311 is shown in FIG. 4 and the other two heat treatment chambers are not shown.

Referring to FIG. 4, the first heat treatment chamber 311 is separated by a partition wall 14A from the other two heat treatment chambers in the furnace body 100.

The first heat treatment chamber 311 has a first yarn inlet 11A1 at a right-hand end portion. A second yarn outlet **11*a*2 and a third yarn inlet 11A3 are provided above the first yarn inlet 11A1. At a left side end portion of the first heat treatment chamber 311, a first yarn outlet 11*a*1 is provided. A second yarn inlet 11A2 and a third yarn outlet 11*a*3 are provided above the first yarn outlet 11*a*1**.

The first yarn inlet 11A1 and the first yarn outlet **11*a*1 are directed substantially horizontally, and face each other. Likewise, the second yarn inlet 11A2 and the second yarn outlet 11*a*2, and the third yarn inlet 11A3 and the third yarn outlet 11*a*3** are directed substantially horizontally, and face each other.

The first heat treatment chamber 311 further has, at a left end portion in its interior, a hot gas leading-in chamber 311B in which four hot gas blowing nozzles 311B1, 311B2, 311B3, 311B4. A blow opening of each hot gas blowing nozzle is formed in a right side surface of the hot gas leading-in chamber 311B and directed toward the interior of the first heat treatment chamber 311.

The first heat treatment chamber 311, at a right end portion in the interior, a hot gas leading-out chamber **311*c* in which four hot gas suction nozzles 311*c*1, 311*c*2, 311*c*3, 311*c*4. A suction opening of each hot gas suction nozzle is formed in a left side surface of the hot gas leading-out chamber 311*c* and directed toward the interior of the first heat treatment chamber 311**.

The clearances between the hot gas blowing nozzles correspond to the first yam outlet **11*a*1, the second yam inlet 11A2 and the third yam outlet 11*a*3. Fiber pass openings (no reference characters) for passing yams are formed in portions in the right side surface of the hot gas leading-in chamber 311B corresponding to the clearances. Likewise, the clearances between the hot gas blowing nozzles correspond to the first yam inlet 11A1, the second yarn outlet 11*a*2 and the third yam inlet 11A3. Fiber pass openings (no reference characters) for passing yarns are formed in portions in the left side surface of the hot gas leading-out chamber 311*c*** corresponding to the clearances.

The hot air outlet chamber **311*c* is connected to an end of a circulation duct 15A. The other end of the circulation duct 15A is connected to the hot gas leading-in chamber 311B. As in the embodiment shown in FIG. 1, a heat gas circulating fan 16A and a heat gas temperature adjusting heater 17A are provided in part way of the circulation duct 15A. In the embodiment shown in FIG. 4, the circulation duct 15A is provided with a hot air flow regulating valve 15A1** for varying the flow of hot air circulated.

A yarn 18 to be subjected to heat treatment is introduced into the first heat treatment chamber 311 through the first yarn inlet 11A1. While being gradually heat-treated, the yarn 18 runs through the interior of the first heat treatment chamber 311, and goes out of the first yarn outlet 11a1 to the outside of the furnace body 10. Then, the yarn 18 is reversed in running direction by the yarn guide roller 19A. The yarn 18 re-enters the first heat treatment chamber 311 from the second yarn inlet 11A2. Then, the yarn 18 runs through a route of the second yarn outlet **11*a*2, the yarn guide roller 19A1, the third yarn inlet 11A3, the first heat treatment chamber 311, the third yarn outlet 11*a*3, and the yarn guide roller 19B. After that, the yarn 18** is introduced into a second heat treatment chamber (not shown).

Heated gas is drawn from the first heat treatment chamber 311 into the hot gas leading-out chamber **311*c* through the four hot gas suction nozzles 311*c*1, 311*c*2, 311*c*3, 311*c*4. Due to heat gas circulating fan 16A, heated gas flows out from the hot air outlet chamber 311*c*, and flows through the circulation duct 15A, and enters the hot air inlet chamber 311B. Through the four nozzles hot air blowing nozzles 311B1, 311B2, 311B3, 311B4, heated gas is supplied into the first heat treatment chamber 311. In part way of the circulation path, the temperature of heated gas is adjusted by the heat gas temperature adjusting heater 17A so that the temperature of heated gas in the first heat treatment chamber 311** becomes a predetermined temperature.

The hot gas circulation and temperature adjustment in the embodiment shown in FIG. 4 is essentially the same as those in the embodiment shown in FIG. 1. The embodiment shown in FIG. 4 is distinguished from the embodiment shown in FIG. 1 in that the embodiment shown in FIG. 4 has, in addition to the circulation duct 15A, an auxiliary hot gas supply passage 23 that is connected to the hot gas leading-in chamber 311B and an auxiliary hot gas discharge passage 25 that is connected to the hot gas leading-out chamber **311*c*. The auxiliary hot gas supply passage 23 has an auxiliary fan 21 and an auxiliary heater 22. The auxiliary hot gas discharge passage 25 has an auxiliary fan 24**.

The auxiliary hot gas supply passage 23 supplies into the hot gas leading-in chamber 311B a small amount of hot gas whose temperature is adjusted to a predetermined temperature by the auxiliary heater 22, using the auxiliary fan 21, so as to maintain a positive pressure in the hot gas leading-in chamber 311B. Thereby, entrance of external air through the first yarn outlet 11a1, the second yarn inlet 11A2 and the third yarn outlet **11*a*3** is prevented.

The auxiliary hot gas discharge passage 25 discharges from the hot gas leading-out chamber 311*c* a small amount of hot gas by the auxiliary fan 24, so as to reduce the pressure in the hot gas leading-out chamber 311*c* to a level equal to or close to the atmospheric pressure. Thereby, leakage (leak-out) of hot gas from the first yarn inlet 11A1, the second yarn outlet 11*a*2 and the third yarn inlet 11A3 is prevented.

The discharge of a small amount of hot gas by the auxiliary hot gas discharge passage 25 is not necessarily performed by the auxiliary fan 24 but may be naturally discharged using a valve. Furthermore, as indicated by a two-dot line in FIG. 4, gas discharged by the auxiliary fan 24 may be supplied into the auxiliary hot gas supply passage 23.

The embodiment shown in FIG. 4 may have a reduced energy efficiency, compared with the embodiment shown in FIG. 1. However, in the embodiment shown in FIG. 4, the pressure in the hot gas leading-in chamber 311B and the hot gas leading-out chamber 311*c* are controlled at appropriate levels to reduce entrance of external air into the hot gas leading-in chamber 311B (flow-in through slits forming the yarn inlet and outlet openings) and to reduce leakage of hot gas from the hot gas leading-out chamber 311*c* (leak-out from slits forming the yarn inlet and outlet openings).

Next described will be still another embodiment of the heat treatment furnace of the invention that employs measures against entrance of external air into a heat treatment chamber and against leakage of hot gas (heated air) from the heat treatment chamber.

Figure 5:
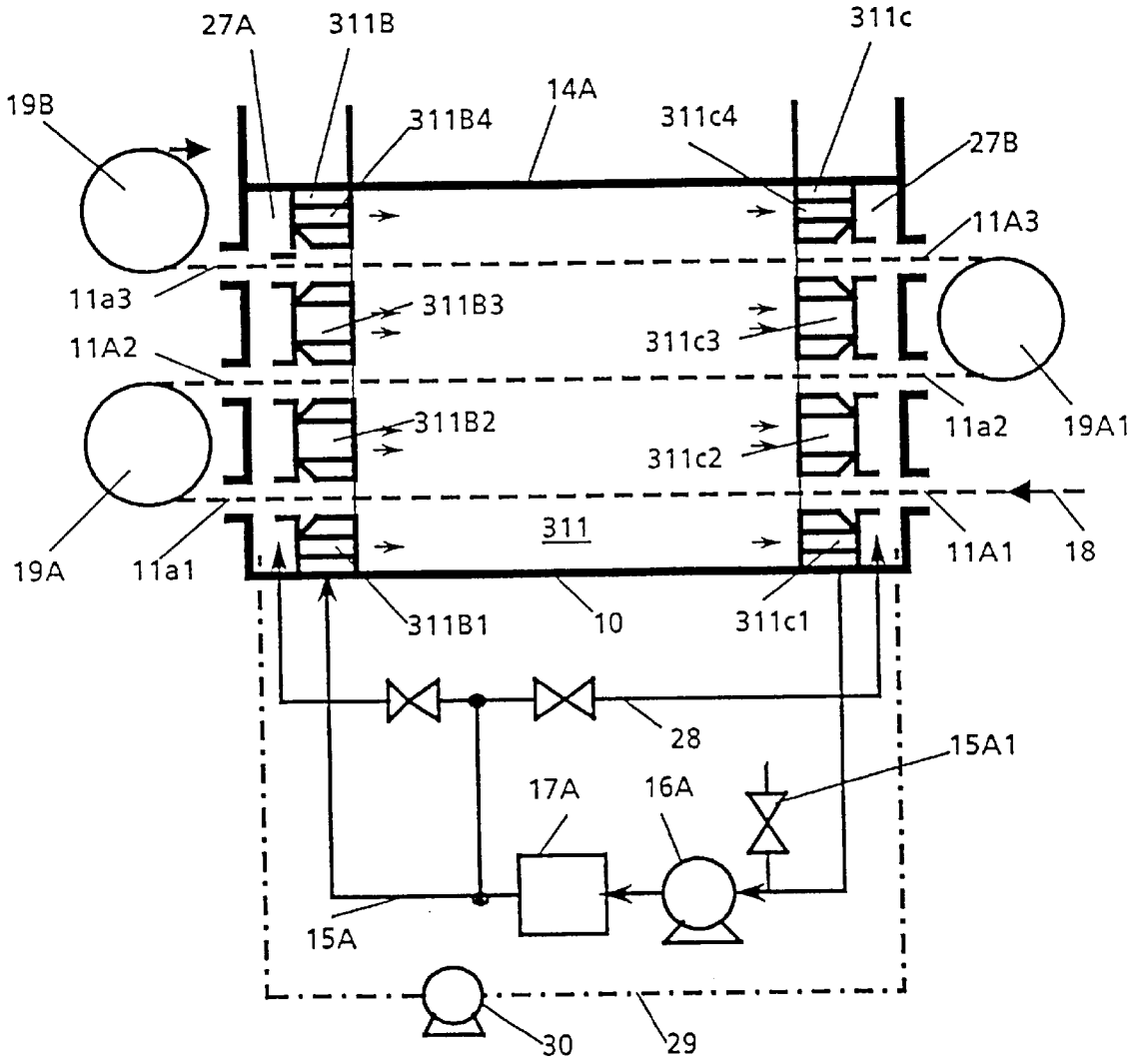
FIG. 5 is a schematic longitudinal view of a modification of one of the heat treatment chambers of the heat treatment furnace for fiber shown in FIG. 4.

FIG. 5 is a schematic longitudinal view of still another embodiment of the heat treatment furnace of the invention. In the embodiment shown in FIG. 5, a modification from the embodiment shown in FIG. 4 is provided, that is, auxiliary pressurizing chambers are provided outside the hot gas leading-in chamber 311B and the hot gas leading-out chamber 311*c*.

Portions of the embodiment shown in FIG. 5 comparable to those of the embodiment shown in FIG. 4 are represented by comparable reference characters in FIG. 5, and will not described again below.

Referring to FIG. 5, a first pressurizing chamber 27A is formed outside the hot gas leading-in chamber 311B, on a side of the hot gas leading-in chamber 311B. A second pressurizing chamber 27B is formed outside the hot gas leading-out chamber 311*c*, on a side of the hot gas leading-out chamber 311*c*. The outside surfaces of the first pressurizing chamber 27A and the second pressurizing chamber 27B have yarn inlets and yarn outlets (no reference characters) corresponding to the first, second and third yarn inlets 11A1, 11A2, 11A3 and the first, second and third yarn outlets 11*a*1, 11*a*2, 11*a*3, respectively.

The hot gas leading-out chamber 311*c* and the hot gas leading-in chamber 311B are connected to each other by the circulation duct 15A provided with the heat gas circulating fan 16A and the heat gas temperature adjusting heater 17A, as in the embodiment shown in FIG. 4.

An auxiliary hot gas supply passage 28 is connected to the first pressurizing chamber 27A and the second pressurizing chamber 27B. The auxiliary hot gas supply passage 28 branches from the circulation duct 15A. The auxiliary hot gas supply passage 28 supplies a portion of hot gas circulating through the circulation duct 15A, into the first pressurizing chamber 27A and second pressurizing chamber 27B.

With hot gas supplied, pressurized condition is maintained in the first pressurizing chamber 27A and the second pressurizing chamber 27B, thereby reducing entrance of external air into the heat treatment chamber 311 through the first yarn outlet 11*a*1, the second yarn inlet 11A2 and the third yarn outlet 11*a*3 of the heat treatment chamber 311 and reducing leakage of hot air from the first yarn inlet 11A1, the second yarn outlet 11*a*2 and the third yarn inlet 11A3 of the heat treatment chamber 311, to outside the heat treatment chamber 311.

Other than the manners described above, it is also possible to allow a portion in the hot gas leading-in chamber 311B to leak directly into the first pressurizing chamber 27A, or to allow a portion in the hot gas leading-out chamber 311*c* to leak directly into the second pressurizing chamber 27B so that the pressure in the first and second pressurizing chambers 27A, 27B become adjusted to a pressurized side.

Furthermore, it is also possible to connect a pressurizing gas-dedicated supply passage having a pressurization adjusting fan heater, directly to the first pressurizing chamber 27A and the second pressurizing chamber 27B in addition to or in place of the auxiliary hot gas supply passage 28.

Further, as indicated by a two-dot line in FIG. 5, a passage may be provided for allowing gas discharge from the second pressurizing chamber 27B and supply of the discharge gas into the first pressurizing chamber 27A. An auxiliary fan 30 is provided in part way of the passage for controlling the pressure in each pressurizing chamber.

Labyrinth seal portions, that is, a well-known sealing device, may also be provided in a yarn inlet and outlet openings, in order to reduce entrance of external air into the heat treatment chamber and leakage of hot gas from the heat treatment chamber.

The embodiment shown in FIG. 5 may have construction wherein a pressurizing chamber (first pressurizing chamber 27A) is provided only on the side of the hot gas leading-in chamber 311B, with no pressurizing chamber provided on the side of the hot gas leading-out chamber 311*c*. Since on the side of the hot gas leading-in chamber 311B, there is a need to prevent external air from flowing into the first heat treatment chamber 311, the pressurizing chamber is provided. By adjusting the pressure in the pressurizing chamber, entrance of external air is prevented. However, on the side of the hot gas leading-out chamber 311*c*, leakage of hot air to a certain extent does not substantially affect the temperature in the first heat treatment chamber 311 although it causes an energy efficiency problem. Therefore, this construction enables control of the temperature in the first heat treatment chamber 311 at a predetermined temperature although energy efficiency reduction decreases to a certain extent.

Figure 6:
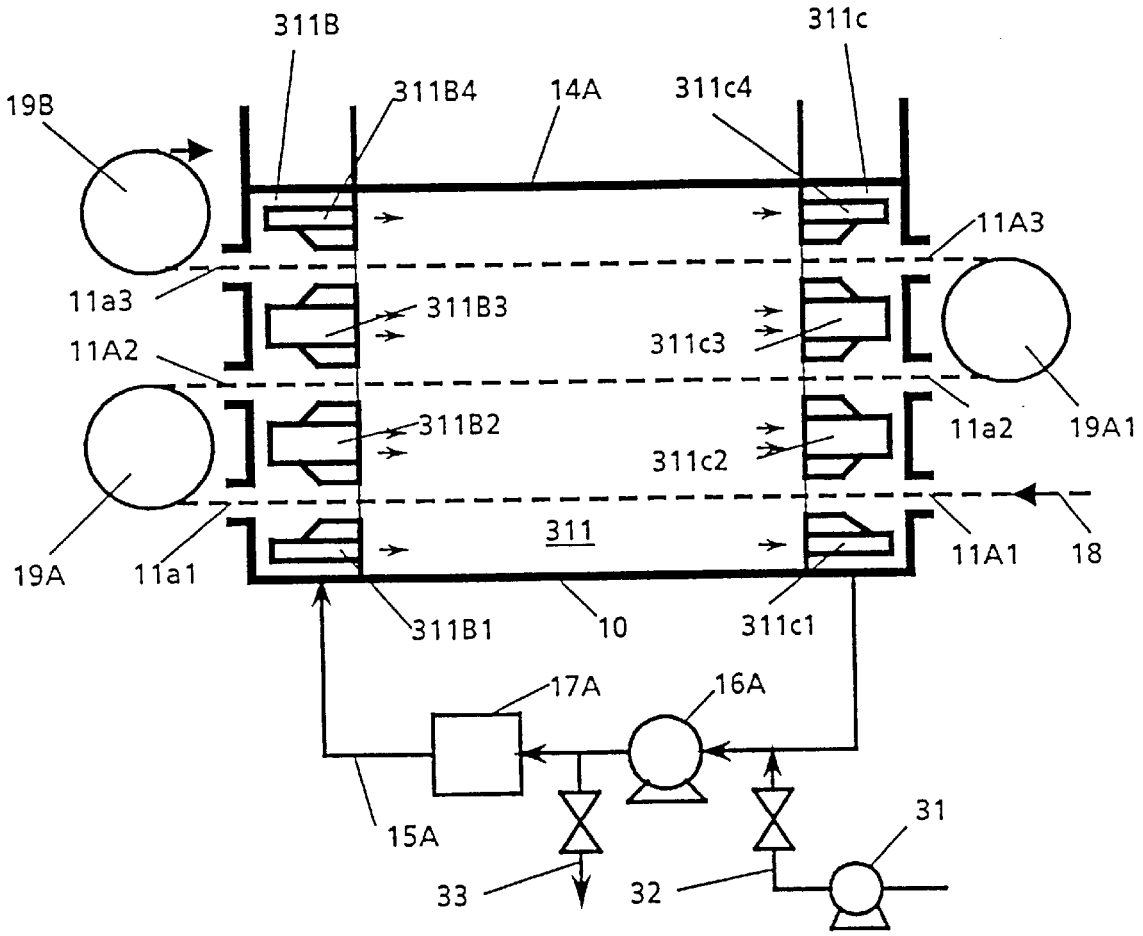
FIG. 6 is a schematic longitudinal view of another modification of one of the heat treatment chambers of the heat treatment furnace for fiber shown in FIG. 4.

FIG. 6 is a schematic longitudinal sectional view of an embodiment wherein the heat treatment furnace shown in FIG. 4 is modified. In the embodiment shown in FIG. 6, the auxiliary hot gas supply passage 23 and the auxiliary hot gas discharge passage 25 employed in the embodiment shown in FIG. 4 are omitted, and an auxiliary intake circuit 32 provided with an auxiliary fan 31, and an auxiliary exhaust circuit 33 are provided.

In the embodiment shown in FIG. 5, the pressure in the hot gas leading-in chamber 311B on the hot gas supply side and the pressure in the hot gas leading-out chamber 311*c* are adjusted by the auxiliary intake circuit 32 and the auxiliary exhaust circuit 33. More specifically, on a side downstream from the heat gas circulating fan 16A of the circulation duct 15A, the pressure in the hot gas leading-in chamber 311B is adjusted by the auxiliary exhaust circuit 33 adjusting exhaust, so as to reduce entrance of external air. On a side upstream from the heat gas circulating fan 16A, the pressure in the hot gas leading-out chamber 311*c* is adjusted by supplying thereto a small amount of gas from the auxiliary intake circuit 32 provided with auxiliary fan 31, so as to reduce leakage of hot gas to the outside. By adjusting the balance between intake and exhaust in this manner, entrance of external air into the heat treatment chamber 311 and leakage of hot gas from the heat treatment chamber 311 can also be reduced.

Specific examples of countermeasures for entrance of external air into a heat treatment chamber and leakage of hot gas from the heat treatment chamber have been described hitherto. The control of heat treatment temperature in a heat treatment chamber requires a high precision. Particularly, a high control precision is required for oxidizing treatment.

A heat treatment chamber according to invention that satisfies the aforementioned requirement will be described below with reference to FIG. 7.

Figure 7:
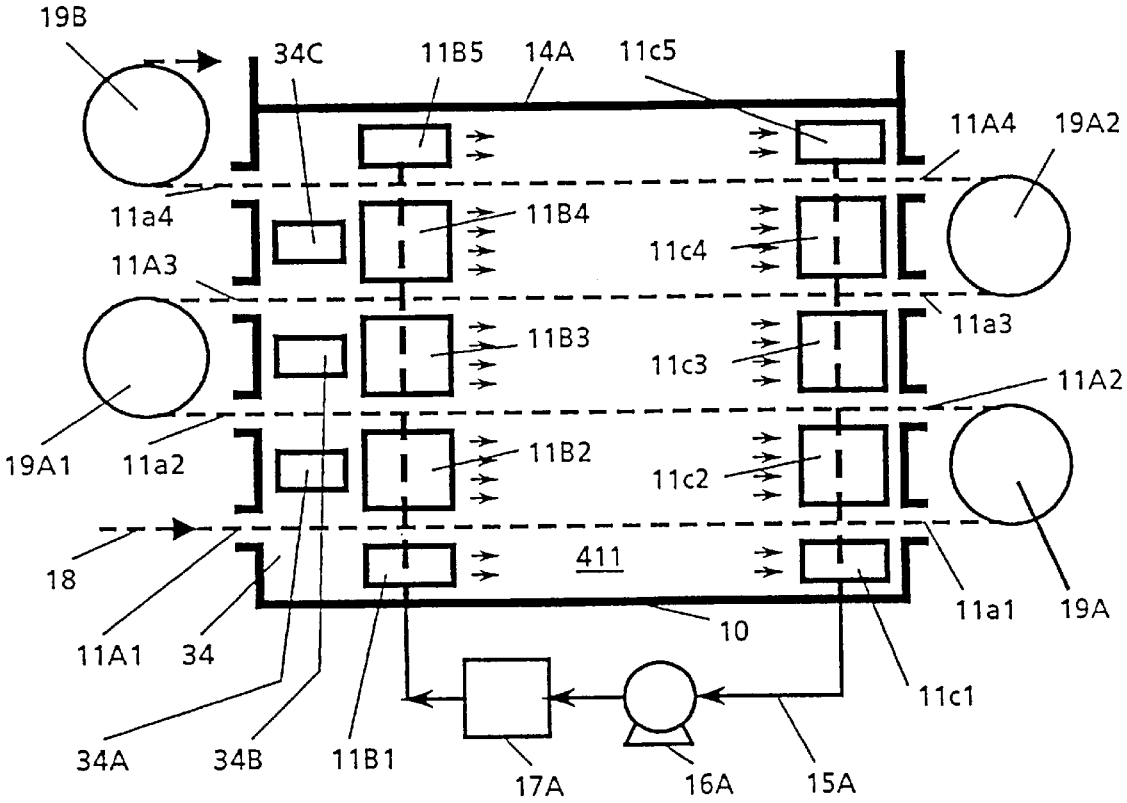
FIG. 7 is a schematic longitudinal view of still another modification of one of the heat treatment chambers of the heat treatment furnace for fiber shown in FIG. 4.

FIG. 7 is a schematic longitudinal sectional view of a further embodiment of the heat treatment furnace of the invention. In the embodiment shown in FIG. 7, the first heat treatment chamber 111 of the embodiment shown in FIG. 2 is modified. In a first heat treatment chamber 411 of a furnace body 10 shown in FIG. 7, elements comparable to those of the first heat treatment chamber 111 shown in FIG. 2 are represented by comparable reference characters, and will not described again.

The embodiment shown in FIG. 7 differs from the embodiment shown in FIG. 2 in that the direction of initial introduction of a yarn 18 into the heat treatment chamber is opposite. A most significant difference is that the embodiment shown in FIG. 7 has an external air temperature-increasing zone 34 between a left side of the hot gas leading-in chambers 11B1–11B5 in the embodiment shown in FIG. 2 and a left side wall of the furnace body 10 provided with yarn outlet and inlet openings.

In the external air temperature-increasing zone 34, a first heater 34A is disposed between the first passage 18A of a yarn 18 and the second passage 18B, and a second heater 34B is disposed between the second passage 18B and the third passage 18C of the yarn 18, and a third heater 34C is disposed between the third passage 18C and the fourth passage 18D of the yarn 18.

The heaters 34A–34C increases the temperature of external air that flows in through the first yarn inlet 11A1, the second yarn outlet 11*a*2, the third yarn inlet 11A3 and the fourth yarn outlet 11*a*4. By thus heating external air at this site, the temperature variation in the oxidizing treatment becomes small, so that stable oxidizing treatment can be performed.

A preferred construction of a heat treatment chamber of the heat treatment furnace of the invention will be described below.

In the heat treatment furnace of the invention, there is a specific relationship between the area of a cross-section of a heat treatment chamber and the total area of the hot gas outlet openings that are directed toward the interior of the heat treatment chamber. With such a specific relationship, it is possible to minimize the turbulence area that causes the problem of contact of a treated article (oxidized yarn) as described above and to thereby prevent failures or trouble or quality deterioration.

Figure 8:
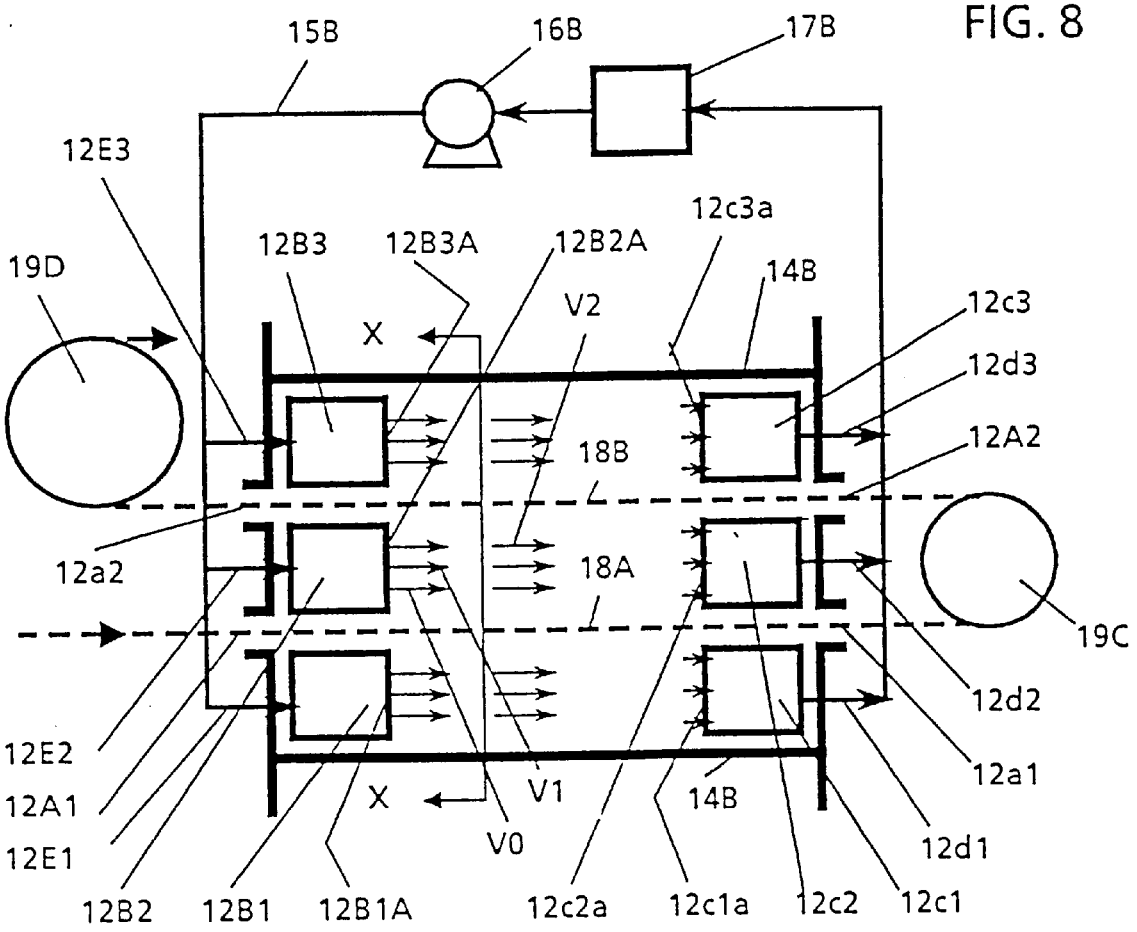
FIG. 8 is a schematic longitudinal view of one of the heat treatment chambers of the heat treatment furnace for fiber according to another embodiment.

FIG. 8 is a schematic longitudinal sectional view of a heat treatment chamber that may be suitably used as a heat treatment chamber of a heat treatment furnace of the invention. An heat treatment chamber 512 shown in FIG. 8 has partition walls 14A, 14B at its top and bottom. The heat treatment chamber 512 has a first yarn inlet 12A1 in its left-hand side surface. A second yarn outlet 12*a*2 is provided above the first yarn inlet 12*a*1. In a left side surface of the first heat treatment chamber 512, a first yarn outlet 12*a*1 is provided. A second yarn inlet 12A2 is provided above the first yarn outlet 12*a*1.

The first yarn inlet 12A1 and the first yarn outlet 12*a*1 are directed substantially horizontally, and face each other. Likewise, the second yarn inlet 12A2 and the second yarn outlet 12*a*2 are directed substantially horizontally, and face each other.

The first heat treatment chamber 512 further has, at a left end portion in its interior, a first hot gas leading-in chamber 12B1, a second hot gas leading-in chamber 12B2 and a third hot gas leading-in chamber 12B3 and, at a right end portion in the interior, a hot gas leading-out chamber 12*c*1, a second gas outlet chamber 12*c*2 and a third gas outlet chamber 12*c*3.

A clearance between an upper surface of the first hot gas leading-in chamber 12B1 and a lower surface of the second hot gas leading-in chamber 12B2 corresponds to the first yarn inlet 12A1. A clearance between an upper surface of the second hot gas leading-in chamber 12B2 and a lower surface of the third hot gas leading-in chamber 12B3 corresponds to the second yarn outlet 12*a*2. A clearance between an upper surface of the first hot gas leading-out chamber 12*c*1 and a lower surface of the second hot gas leading-out chamber 12*c*2 corresponds to the first yarn outlet 12*a*1. A clearance between an upper surface of the second hot gas leading-out chamber 12*c*2 and a lower surface of the third hot gas leading-out chamber 12*c*3 corresponds to the second yarn inlet 12A2.

The hot gas leading-out chambers 12*c*1, 12*c*2, 12*c*3 are connected to hot gas outlet branch ducts 12*d*1, 12*d*2, 12*d*3. The other end of each of the hot gas outlet branch ducts 12*d*1, 12*d*2, 12*d*3 is connected to a circulation duct 15B. The hot gas leading-in chambers 12B1, 12B2, 12B3 are connected to hot gas inlet branch ducts 12E1, 12E2, 12E3. The other end of each of the hot gas inlet branch ducts 12E1, 12E2, 12E3 is connected to the circulation duct 15B.

Hot gas suction openings 12*c*1*a*, 12*c*2*a*, 12*c*3*a* are formed in left side surfaces of the hot gas leading-out chambers 12*c*1, 12*c*2, 12*c*3, and hot gas blow openings 12B1A, 12B2A, 12B3A are formed in right side surfaces of the hot gas leading-in chambers 12B1, 12B2, 12B3.

A heat gas temperature adjusting heater 17B is provided in part way of the circulation duct 15B. A heat gas circulating fan 16B is provided downstream from the heat gas temperature adjusting heater 17B. The hot gas outlet branch ducts 12*d*1, 12*d*2, 12*d*3, the circulation duct 15B and the hot gas inlet branch ducts 12E1, 12E2, 12E3 form a hot gas circulation duct for the heat treatment chamber 512.

A yarn 18A to be subjected to heat treatment (oxidizing treatment) in the heat treatment chamber 512 is first introduced into the heat treatment chamber 512 from the first yarn inlet 12A1. Subsequently, the yarn 18A is caused to run to the right in FIG. 8 in the heat treatment chamber 512, and led out to the outside of the heat treatment chamber 512 (outside the furnace body) from the first yarn outlet 12*a*1. By a yarn guide roller 19C provided outside the heat treatment chamber 512, the running direction of the yarn 18A is reversed. The yarn 18B is then introduced into the heat treatment chamber 512 again, through the second yarn inlet 12A2. The yarn 18B, which has been heat-treated (oxidized) to a certain extent, is caused to run to the left in FIG. 8 in the heat treatment chamber 512, and then led out to the outside of the heat treatment chamber 512, from the second yarn outlet 12*a*2. If necessary, the yarn 18B is reversed in running direction by a yarn guide roller 19D provided outside the heat treatment chamber 512 (outside the furnace body), and then introduced into the next heat treatment chamber.

The heat treatment (oxidizing treatment) of the yarn 18A, 18B in the heat treatment chamber 512 is performed in heated gas (heated oxidative gas, or heated air). Heated gas is drawn into the hot gas leading-out chambers 12*c*1, 12*c*2, 12*c*3 through the hot gas suction openings 12*c*1*a*, 12*c*2*a*, 12*c*3*a*, and then flows into the circulation duct 15B via the hot gas outlet branch ducts 12*d*1, 12*d*2, 12*d*3. In the circulation duct 15B, the temperature of heated gas (heated air) is adjusted by the heat gas temperature adjusting heater 17B so that a required heat treatment temperature in the heat treatment chamber 512 is maintained. By the heat gas circulating fan 16B, heated gas is supplied into the hot gas leading-in chambers 12B1, 12B2, 12B3, via the circulation duct 15B and the hot gas inlet branch ducts 12E1, 12E2, 12E3. Heated gas (heated air) is then blown from the hot air blow openings 12B1A, 12B2A, 12B3A of the hot gas leading-in chambers 12B1, 12B2, 12B3 into the heat treatment chamber 512 in a direction substantially parallel to the passages of the yarn 18A, 18B (substantially horizontal direction)

The construction of the heat treatment chamber 512 and the circulation and temperature control of heated gas (heated air, hot gas) are approximately the same as those of the embodiment 1 shown in FIG. 1. The embodiment shown in FIG. 8 differs from the embodiment shown in FIG. 1 in the following respect.

In the embodiment shown in FIG. 8, illustrating a preferred mode of the embodiment shown in FIG. 1, the heat treatment chamber 512 has a specific relationship between the area of a cross-section of the heat treatment chamber 512 and the area of the side surfaces of the hot gas leading-in chambers 12B1, 12B2, 12B3 provided with the hot gas blow openings 12B1A, 12B2A, 12B3A. The specific relationship will be described below with reference to FIG. 9.

Figure 9:
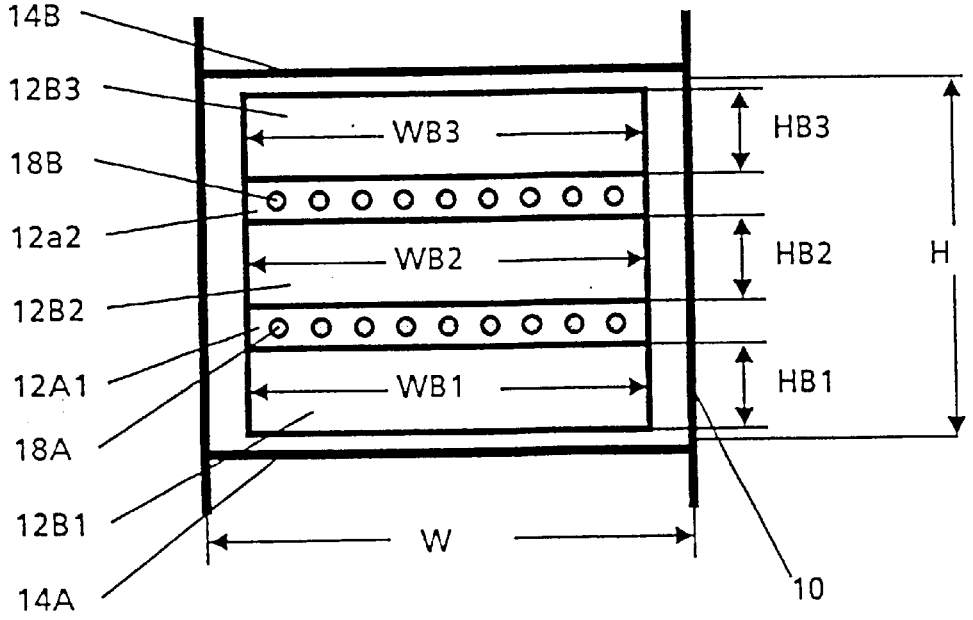
FIG. 9 is a sectional view of the heat treatment chamber taken on plane X—X of FIG. 8.

FIG. 9 is a sectional view taken on plane X—X of FIG. 8. In FIG. 9, W represents a lateral width of the heat treatment chamber 512, and H represents a height of the heat treatment chamber 512. WB1 and HB1 represent a lateral width and a height of the first hot gas leading-in chamber 12B1, and WB2 and HB2 represent a lateral width and a height of the second hot gas leading-in chamber 12B2, and WB3 and HB3 represent a lateral width and a height of the third hot gas leading-in chamber 12B3.

The heat treatment chamber 512 shown in FIG. 8 is constructed so that the area Ss (Ss=W×H) of a cross-section (section on a plane substantially perpendicular to the passages of the yarn 18A, 18B) of the interior space of the heat treatment chamber 512 and the total area Sf (Sf=WB1×HB1+WB2×HB2+WB3×HB3) of the side surfaces of the hot gas leading-in chambers 12B1, 12B2, 12B3 provided with the hot gas blow openings 12B1A, 12B2A, 12B3A satisfy the relationship: $Ss/Sf \leqq 2$.

In this construction, it is preferred that the average blowing speeds $V_0$ of hot gas at the individual hot gas blow openings 12B1A, 12B2A, 12B3A be the same blowing speed. It is also preferred that the variation of blowing speed over the width and over the height of each of the hot gas blow openings 12B1A, 12B2A, 12B3A be as small as possible. A preferred range of the variation is within the range of $V_0 \pm 10\%$. The structure of the hot gas blow openings for consistent flowing speed will be described below.

In the case of a consistent blowing speed distribution as described above, it is preferred that a ratio $V_1/V_2$ between the maximum blowing speed $V_1$ of hot gas at the hot gas blow openings 12B1A, 12B2A, 12B3A and the maximum blowing speed $V_2$ at position 1 m apart from these hot gas blow openings in a horizontal direction be at most 1.1. Such a blowing speed ratio is achieved if the aforementioned relationship $Ss/Sf \leqq 2$ is satisfied, as will be apparent from the description of embodiments below.

Figure 10:
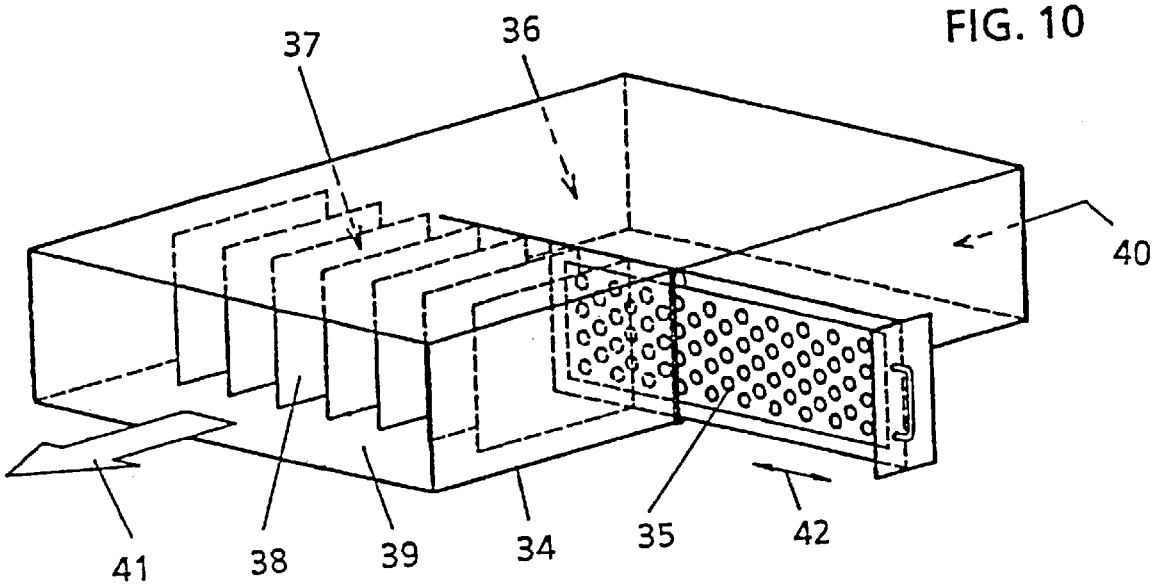
FIG. 10 is a perspective view of an example of a hot gas blow nozzle that is mounted in a hot gas leading-in chamber of a heat treatment furnace according to the invention.

Next described with reference to FIG. 10 is a specific example of the structure of a hot blowing nozzle that is mounted in a hot gas leading-in chamber of a heat treatment chamber of a heat treatment furnace according to the invention. The hot gas blowing nozzle constitutes a hot gas blow opening for blowing hot gas in a direction substantially parallel to the yarn running passage in a consistent blowing speed distribution.

FIG. 10 is a perspective view of an example of the hot gas blow opening of a heat treatment chamber of a heat treatment furnace according to the invention. Referring to FIG. 10, a hot gas blowing nozzle 34 is formed of a hollow body having the shape of a rectangular parallelepiped with front and rear openings. The interior of the hot gas blowing nozzle 34 is divided into two chambers by a pressure-equalizing plate 35 formed of a porous plate. The rearward chamber is a pressure equalization chamber 36, and the forward chamber is a straightening chamber 37. The straightening chamber 37 has a plurality of vertically-extending straightening plates 38 that are arranged in parallel at intervals. A forward open end 39 of the hot gas blowing nozzle 34 forms the hot gas blow opening (for example, the hot gas blow opening 11B1A shown in FIG. 1). A rearward open end 40 communicates with the hot gas leading-in chamber (for example, the hot gas leading-in chamber 11B1 shown in FIG. 1).

Hot gas is supplied from the hot gas leading-in chamber 40 into the pressure equalization chamber 36, where the pressure of hot gas is equalized. Subsequently, hot gas passes through the pressure-equalizing plate 35 and flow into the straightening chamber 37. By the action of the straightening plates 38 of the straightening chamber 37, hot gas is straightened. The straightened hot gas 41 is blown out of the hot gas blow opening 30 into the heat treatment chamber (for example, the first heat treatment chamber 11 shown in FIG. 1). The pressure-equalizing plate 35 is detachably mounted in the hot gas blowing nozzle 34 as indicated by arrows 42 in FIG. 10.

The thus-constructed heat treatment chamber satisfies the aforementioned relationship $Ss/Sf \leqq 2$, and therefore forms good parallel streams of hot gas along the passages of the yarn 18A, 18B (see FIG. 8). As a result, the construction prevents occurrence of a large turbulence region caused by flow of hot gas inside the heat treatment chamber. Furthermore, since the aforementioned relationship $V_1/V_2 \leqq 1.1$ is also satisfied, parallel streams of hot gas at a predetermined speed over the entire range in the heat treatment chamber are formed, so that heat treatment (oxidizing treatment) with a high heat conducting efficiency is achieved.

Due to substantial prevention of occurrence of a turbulence region, occurrence of filament breakage and fuzzing of a yarn due to contact of the yarn with an external object or the yarn itself caused by the fluttering of the yarn during, in particular, oxidizing treatment, is substantially prevented. Furthermore, occurrence of trouble caused by tangling of a broken filament onto a yarn guide roller is prevented. Therefore, a stable operation of the heat treatment process is enabled. Further, since fuzzing and filament breakage is substantially prevented and highly efficient heat treatment is made possible as described above, quality deterioration of finally-produced heat-treated fiber products (carbon fiber products) is prevented. Therefore, production of fiber products with desired characteristics (carbon fibers having high strength, high elastic coefficient) becomes possible.

Figure 11:
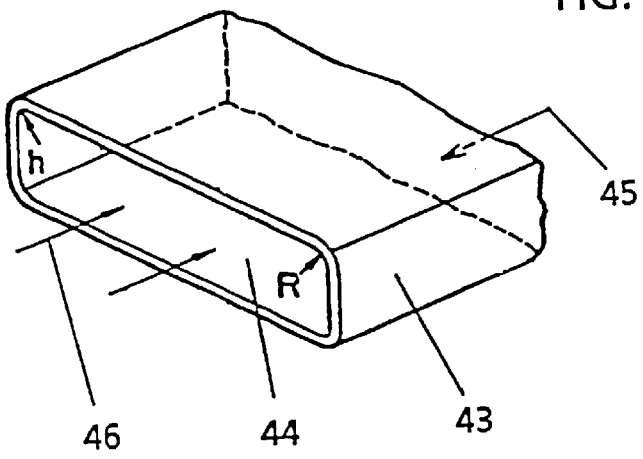
FIG. 11 is a perspective view of an example of a hot gas suction nozzle that is mounted in a hot gas leading-out chamber of a heat treatment furnace according to the invention.

Next described with reference to FIG. 11 is an example of a hot suction nozzle which is mounted in a hot gas leading-out chamber of a heat treatment chamber of a heat treatment furnace according to the invention. The hot gas suction nozzle forms a hot gas suction opening for drawing in hot gas from the interior of the heat treatment. FIG. 11 is a perspective view of an example of the hot gas suction opening of a heat treatment chamber of a heat treatment furnace according to the invention. Referring to FIG. 11, a hot gas suction nozzle 43 is formed of a hollow body having the shape of a rectangular parallelepiped with front and rear openings. A forward open end 44 of the hot gas suction nozzle 43 forms the hot gas suction opening (for example, the hot gas suction opening 11*c*1*a* shown in FIG. 1). A rearward open end 45 communicates with the hot gas leading-out chamber (for example, the hot gas leading-out chamber 11*c*1 shown in FIG. 1). Hot gas 46 is drawn from the interior of a heat treatment chamber (for example, the first heat treatment chamber 11 shown in FIG. 1) through the hot gas suction opening 44, into the hot gas suction nozzle 43, and then flows into the hot gas leading-out chamber 45.

A opening peripheral end portion of the hot gas suction opening 44 is rounded, and four corner portions of the rectangular parallelepiped are also rounded as shown in FIG. 1. The reason for the rounding of edges and corners is that if not rounded, such a edge or corner portion may catch a broken filament if a filament breaks and is sucked into the hot gas suction opening 44 during heat treatment, and the broken filament thus caught may brake the normal running of a yarn (for example, the yarn 18A, 18B). If such edge and corner portions are rounded, a broken filament will not be caught, thereby preventing an event that a caught filament is then pulled by a running yarn and, therefore, brakes the normal yarn running. From this viewpoint, it is also preferable to finish the inner surfaces and opening end surfaces of the hot gas suction nozzle 43 into smooth-sliding surfaces.

Figure 12:
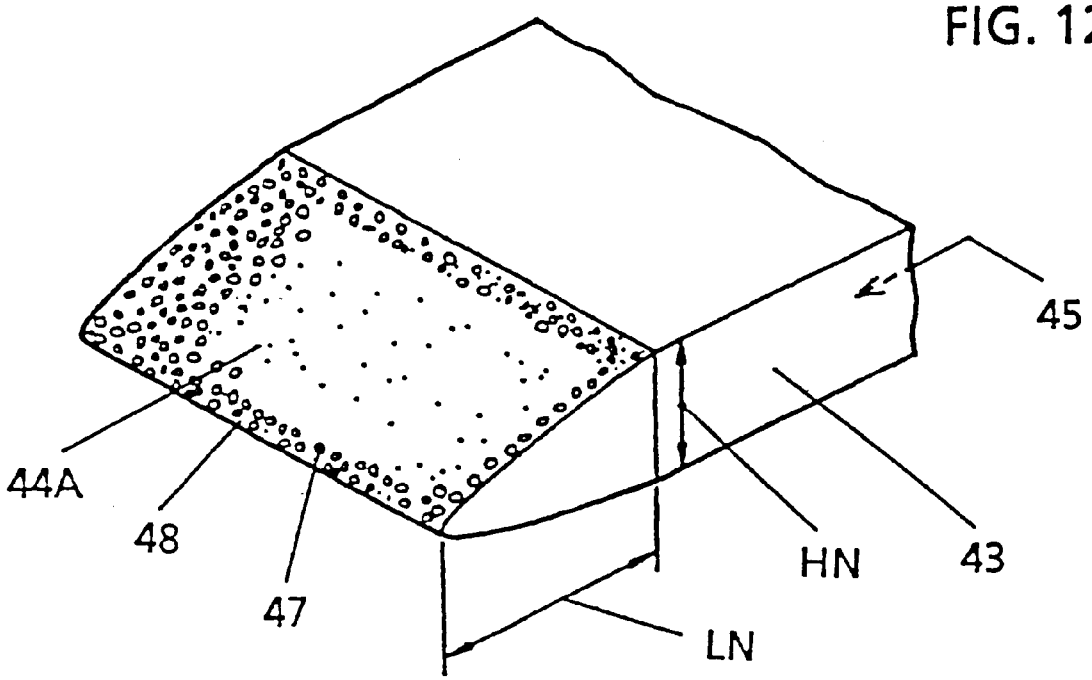
FIG. 12 is a perspective view of a modification of the hot gas suction nozzle shown in FIG. 11.

FIG. 12 is a perspective view of a modification of the hot gas suction opening 44 shown in FIG. 11. Referring FIG. 12, a hot gas suction opening 44A has a tip portion 48 that is formed of an outwardly-curved porous plate 47. This construction prevents a broken filament from going deep into the hot gas leading-out chamber 45 and allows the broken filament to easily return to the yarn as the yarn runs.

The pore rate of the porous plate 47 is preferably at least 30% and, more preferably, at least 40%, in order to avoid a reduction in hot gas suction performance. The pore diameter is preferably within the range of 3–15 mm. It is also preferred that the relationship between the height HN of a read end portion of the hot gas suction opening 44A and the length LN thereof from the rear end portion to the tip portion 48 satisfy LN/HN approximately equaling 2. Furthermore, it is preferred that the hot gas suction opening 44A be detachably mounted to the hot gas suction nozzle 43.

When a heat treatment furnace for fiber according to the invention is used to produce an oxidized fiber for use in production of a carbon fiber, it is preferred that a generally flat rectangular cross-sectional shape of a yarn (precursor yarn) formed of many filaments be maintained while being subjected to heat treatment for oxidation, in view of prevention of heat accumulation in the yarn during heat treatment and acceleration of heat removal.

From this viewpoint, it is preferred that the yarn have a denier per unit width within the range of 2–20 kd/mm where k is unit of 1,000 and d is denier, and remain spread in a flat shape during oxidizing treatment. A more preferred denier range is 4–10 kd/mm. It is also preferred that the cross-sectional shape of the yarn be a generally flat rectangular shape having a mean flattening of 10–50.

The term "generally rectangular shape" includes a rectangular shape having round corners. The "mean flattening " refers to a value of WY/TY where TY is a mean of measurements of the thickness of a yarn obtained at five sites in the direction of width of the yarn using a known photoelectric transmission measuring device when the running of the yarn is stopped, and WY is a mean of measurements of the width of the yarn obtained at five sites at intervals of 1 cm in the direction of length of the yarn using a caliper.

If the mean flattening is less than 10, the yarn thickness becomes great so that run-away reaction may occur due to accumulation of reaction heat during oxidizing treatment. Such run-away reaction will likely result in filament breakage or firing. If the oxidizing treatment temperature is excessively reduced for the purpose of controlling the reaction, an inconveniently prolonged oxidizing treatment time results, thus reducing productivity.

If the mean flattening exceeds 50, the yarn width becomes great, so that the number of yarns that can be simultaneously treated within the width of the heat treatment chamber for oxidizing treatment (that is, a dimension thereof perpendicular to the yarn running direction) decreases, thereby reducing the productivity of the equipment. Therefore, the mean flattening is preferably within the range of 10–50 and, more preferably, within the range of 15–35.

The heat treatment of a yarn with a flat cross-sectional shape can be achieved by a heat treatment furnace equipped with yarn guide rollers whose yarn-contact portions have a specific shape. An example of such yarn guide rollers will be described below.

Figure 13:
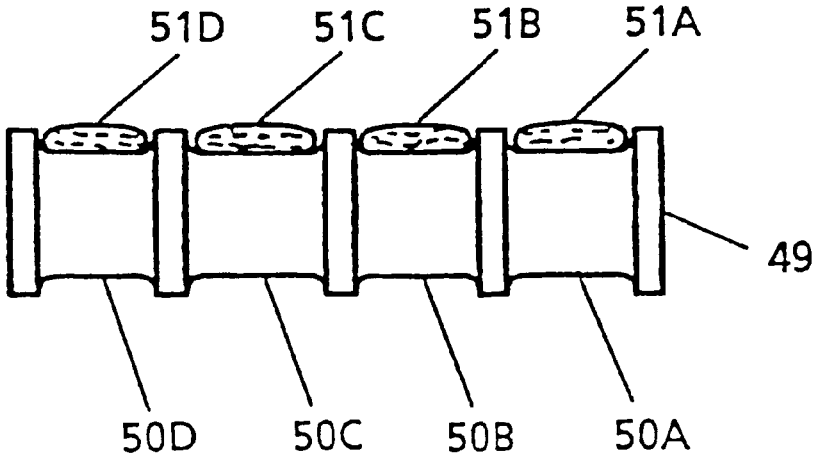
FIG. 13 is a schematic front elevation of an example of a yarn guide roller that is used in a heat treatment furnace for fiber according to the invention.

FIG. 13 is an elevation of a preferred example of a yarn guide roll for use in a heat treatment furnace according to the invention as described above. Referring to FIG. 13, a yarn guide roller 49 has four grooves 50A, 50B, 50C, 50D on its peripheral surface. That is, the yarn guide roller 49 is able to simultaneously supply four yarns in parallel into a heat treatment chamber. As shown in FIG. 13, four yarns 51A, 51B, 51C, 51D to be simultaneously subjected to oxidizing treatment are supported on the four grooves. Due to the shape of the grooves, the yarns 51A, 51B, 51C, 51D guided by the grooves become flat in cross-sectional shape when the yarns are running. While the flat shape is being maintained, the yarns receive heat treatment (oxidizing treatment) in the heat treatment chamber.

A preferred shape of the grooves of the yarn guide roller 49, for example, the groove 50A, shown in FIG. 13 will be described.

Figure 14:
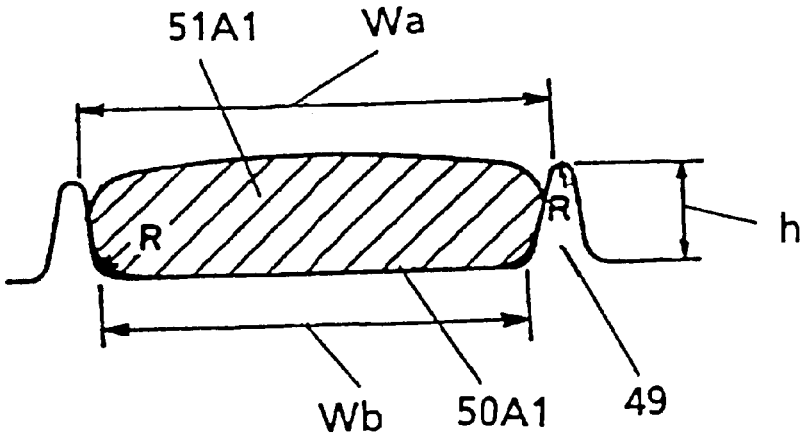
FIG. 14 is a front elevation of a modification of the yarn guide roller shown in FIG. 13.

FIG. 14 is an elevational longitudinal sectional view of a more preferred yarn guide groove formed on a peripheral surface of the yarn guide roller 49 shown in FIG. 13. In the yarn guide groove 50A1, Wa represents a width of the groove at a top portion, and Wb represents a width of the groove at a bottom portion, and h represents a depth of the groove, and R is a radius of at least a rounded bottom corner portion. A preferred groove shape satisfies the following relational expressions, using the aforementioned characters:

$$0.7 \leqq Wb/Wa \leqq 1 \quad (I)$$

$$0.2 \times Wa \leqq h \leqq 0.4 \times Wa \quad (II)$$

$$0.2 \times (Wa - Wb) \leqq R \leqq 0.4 \times (Wa - Wb) \quad (III)$$

In order to maintain a generally flat rectangular cross-sectional shape of a yarn to be subjected to oxidizing treatment, it is necessary to provide the groove 50A1 with a certain bottom width. If the ratio Wb/Wa between the top width Wa and the bottom width Wb of the groove is less than 0.7, the groove shape becomes more like a V-shape, that is, less rectangular. If Wb/Wa exceeds 1, the groove shape becomes more like an inverted V-shape, and therefore makes the groove shaping more difficult.

With regard to expression (II), which limits the depth of the groove of the roller, if the groove depth h, which is not necessarily determined by expression (II), is less than the multiplication product of 0.2 and the groove top width Wa, a portion of the running yarn 51A1 may go over a wall of the groove 50A1, so that entangling contact with a neighboring yarn may occur causing fuzzing. If the groove depth h exceeds the multiplication product of 0.4 and the groove top width Wa, the ratio of the area of a yarn cross-section (area of a generally rectangular cross-section) to the area of a groove cross-section increases so that the yarn guide roller processing cost increases, that is, the cost efficiency decreases. Therefore, it is preferred that the groove depth h be within the range of one fifth to two fifths of the groove top width Wa.

The radius R of a rounded groove corner portion is not particularly limited. However, if a corner portion has no roundness, an inter-groove protrusion (a top portion of a wall between two adjacent grooves) will likely cut a filament, or a corner in the groove recess (a corner portion at the groove bottom) will likely cause inconsistent thicknesses in an end portion of the yarn. If the groove recess portions are rounded, the rounded corners allow filaments of the running yarn 51A1 to suitably change positions (rearrangement) so that the thickness inconsistency in end portions of the yarn decreases. If the roundness of the inter-groove protrusions is increased more than necessary by increasing the width of the inter-groove protrusions, the length of the yarn guide roller 49 becomes long, leading to a width increase of the heat treatment chamber. Therefore, it is preferred that the radius R of rounded groove corner portions, including the groove bottom corner portions and inter-groove wall top portions, satisfy expression (III).

As for yarn guide rollers, flat rollers are sometimes employed, other than rollers having yarn guide grooves. However, a flat roller makes it difficult to restrict the yarn width and thickness within predetermined ranges, furthermore, may present problems of entanglement of neighboring yarns on a roller, yarn fuzzing, or yarn convolution on a roller.

Figure 15:
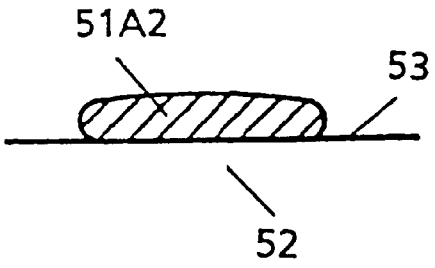
FIG. 15 PRIOR ART
FIG. 15 is an elevational view of a portion of a conventional yarn guide roller.

FIG. 15 is an elevational view of a portion of a flat roller. Referring to FIG. 15, a yarn 51A2 is run in contact with a peripheral surface 53 of a yarn guide roller 52, and thereby introduced into a heat treatment chamber (not shown) and led out from the heat treatment chamber.

Figure 16:
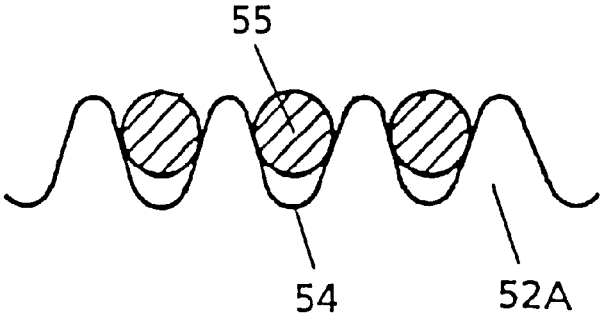
FIG. 16 PRIOR ART
FIG. 16 is an elevational view of a portion of another conventional yarn guide roller.

FIG. 16 is an elevational view of a portion of a yarn guide roller conventionally used in oxidizing treatment. Referring to FIG. 16, a yarn guide roller 52A has a plurality of grooves 54 that are formed on its peripheral surface. A plurality of yarns 55 are guided by the grooves 54. However, with the yarn guide roller 52A, it is not easy to form a desirable flat, generally rectangular cross-sectional shape of the yarns 55. In the case of a yarn having a great denier, in particular, it is substantially impossible to form a flat cross-sectional shape.

In production of an oxidized fiber to be used to produce a carbon fiber employing a heat treatment furnace for fiber and a yarn guide roller according to the invention, it is preferred that a material yarn to produce the oxidized fiber, that is, a precursor yarn, satisfy the conditions as follows.

The precursor yarn is preferably a yarn formed of many polyacrylonitrile-based filaments with a yarn denier (total denier) of at least 30,000 denier.

The tension acting on the yarn in a heat treatment chamber for oxidizing treatment is preferably within the range of $3.8\times10^{-2}$ to $1.9\times10^{-1}$ g/denier on the basis of a precursor yarn, that is, a yarn before being introduced into the first heat treatment chamber. If the tension is less than $3.8\times10^{-2}$ g/denier, the yarn may hang in a heat treatment chamber to slide on the bottom of the heat treatment chamber, producing fuzz. Therefore, deterioration in quality and tensile strength of the carbon fiber obtained in a later carbonizing process may result. If the tension exceeds $1.9\times10^{-1}$ g/denier, the incidence of filament breakage and, therefore, fuzzing in the heat treatment process increases. A broken filament may be convoluted on a yarn guide roller. Therefore, to conduct stable heat treatment and obtain a desired oxidized fiber, the tension acting on the yarn is preferably within the range of $3.8\times10^{-2}$ to $1.9\times10^{-1}$ g/denier and, more preferably, within the range of $5.3\times10^{-2}$ to $1.4\times10^{-1}$ g/denier.

EXAMPLE 1

A polyacrylonitrile (PAN)-based precursor yarn (a single filament denier being 1 denier, the number of filaments being 12,000) was subjected to oxidizing treatment. The yarn running speed was 3 m/minute, and the mean blowing gas speed $V_0$ at the hot gas blow opening was 2 m/s. In a horizontal heat treatment furnace having three heat treatment chambers in a single furnace body, the yarn was guided by yarn guide rollers. The temperature in the first-stage heat treatment chamber was 240° C., and the heat treatment time in the chamber was 10 minutes. The temperature in the second-stage heat treatment chamber was 250° C., and the heat treatment time in the chamber was 10 minutes. The temperature in the third-stage heat treatment chamber was 270° C., and the heat treatment time in the chamber was 10 minutes. Thus, oxidizing treatment was performed for 30 minutes in total. The yarn was passed through each heat treatment chamber three times, that is, two passages in one direction and one passage in the opposite direction. Thus, the yarn was passed through the heat treatment chambers nine times in total (see the heat treatment furnace shown in FIG. 5). The number of occurrences of fuzzing on the resultant oxidized yarn was 3 sites per meter in average.

The carbonization yield of the carbon fiber obtained by carbonizing the oxidized yarn at 1400° C. in a nitrogen atmosphere was 55%, and the strength thereof was 450 kgf/mm$^2$.

COMPARATIVE EXAMPLE 1

A precursor yarn the same as used in Example 1 was subjected to oxidizing treatment at 240° C. using a horizontal heat treatment furnace having one heat treatment chamber in a single furnace body. The yarn running speed in the heat treatment chamber and the mean blowing gas speed $V_0$ at the hot gas blow opening were the same as in Example 1.

In order to achieve a carbonization yield comparable to that of the carbon fiber obtained in Example 1, an oxidizing treatment time of 80 minutes was required. For this end, it was necessary to pass the yarn through the heat treatment chamber 24 times. The number of occurrences of fuzzing on the resultant oxidized yarn was 10 sites per meter in average.

The strength of the carbon fiber obtained by carbonizing the oxidized yarn at 1400° C. in a nitrogen atmosphere was 400 kgf/mm$^2$.

From Example 1 and Comparative Example 1, it is clear that the oxidizing treatment time and the number of occurrences of fuzzing can be reduced by gradually increasing the temperature in a plurality of heat treatment chambers provided in a single furnace.

EXAMPLE 2–4 AND COMPARATIVE EXAMPLES 2–4

A test furnace with an area ratio of the heat treatment chamber to the hot gas blow opening being 4, was manufactured and used for a heat treatment test (oxidizing test of a PAN-based precursor). The shape of the hot gas blow opening remained the same, and movable partition walls were disposed in spaces below and above the heat treatment chamber. By shifting the position of the wall partitions, the area ratio (Ss/Sf) of the heat treatment chamber to the hot gas blow opening was varied to six levels, that is, 1.2, 1.5, 2.9, 2.5, 3.0, 4.0, for the heat treatment test.

The mean blowing gas speed $V_0$ at the hot gas blow opening was 5 m/s. The treatment temperature was 250° C. The number of yarns simultaneously supplied into a heat treatment chamber through a single yarn inlet was 20. The distance between the yarns (supplied yam pitch) was 10 mm. The yarn running speed was 5 m/minute. The thickness of each yarn was 12,000 deniers. The oxidizing treatment time was 45 minutes.

The following parameters were used for evaluation:

(1) Number of fuzzing per meter of oxidized yarn (mean value of 20 samples).

(2) Number of times of yarn convolution in a layer process (times/100 hours).

(3) Maximum gas speed ($V_1$) of hot gas at the hot gas blow opening of the heat treatment chamber, and maximum gas speed ($V_2$) of hot gas at position 1 m apart from the hot gas blow opening.

Test results are shown in Table 1. It was found that a sharply change in the number of occurrences of fuzzing occurs within the area ratio (Sc/Sf) range of 2.0–2.5. When Ss/Sf≦2, the number of times of yarn convolution on yarn guide rollers remarkably changed. Therefore, it is clear that if the area ratio (Ss/Sf) is set to a value equal to or less than 2, a practically excellent heat treatment furnace is provided.

EXAMPLE 5

A polyacrylonitrile-based yarn having a single filament denier of 1.5 d (denier), 70,000 filaments, and a total denier of 105,000 was subjected to oxidizing treatment using a heat treatment furnace substantially the same as the heat treatment furnace shown in FIG. 1. The yarn guide rollers used were yarn guide rollers with grooves as shown in FIG. 13 (yarn guide roller 49). The dimensions of the yarn guide grooves (yarn guide grooves 50A1 in FIG. 14) were: Wa=25 mm, Wb=20 mm, and h=5 mm. The mean flattening of the yarn 51A1 was 23. The apparent mean denier of the yarn 51A1 relative to 1 mm in width was restricted to 4,200 denier. The tension acting on the yarn 51A1 was $5.7\times10^{-2}$ g/denier. The temperature in the first-stage heat treatment chamber was 225° C., and the heat treatment time in the chamber was 20 minutes. The temperature in the second-stage heat treatment chamber was 235° C., and the heat treatment time in the chamber was 20 minutes. The temperature in the third-stage heat treatment chamber was 250° C., and the heat treatment time in the chamber was 20 minutes.

There were no substantial filament breakage and no substantial fuzzing caused by run-away reaction in the oxidizing treatment as describe above. That is, the oxidizing treatment was stably conducted. The resultant oxidized fiber was pre-carbonized at a maximum temperature of 720° C., and then carbonized at a maximum temperature of 1350° C. in an inactive atmosphere. The obtained carbon fiber was an excellent carbon fiber having very little fuzzing and having a tensile strength of 380 kgf/m$^2$ and an elastic coefficient of 24 tf/mm$^2$.

EXAMPLE 6

A polyacrylonitrile-based fiber substantially the same as used in Example 5 was set on grooved rollers substantially the same as in Example 5 so that the tension acting on the yarn became $1.2\times10^{-2}$ g/denier. The mean flattening became 40, and the apparent mean denier of the yarn relative to 1 mm in width became 4,200 denier. The yarn in these conditions was subjected to oxidizing treatment in substantially the same manner as in Example 5. The incidence of filament breakage while the yarn was running increased. Fuzzing to some extent was observed on the resultant oxidized yarn. The oxidized yarn was carbonized in substantially the same manner as in Example 5. The tensile strength of the obtained carbon fiber slightly decreased to 280–300 kgf/mm$^2$.

EXAMPLE 7

A polyacrylonitrile-based fiber substantially the same as used in Example 5 was set on grooved roller the same as used in Example 5 so that the tension acting on the yarn became $4.3\times10^{-2}$ g/denier. The mean flattening became 130, and the apparent mean denier of the yarn relative to 1 mm in width became 4,200 denier. The yarn in these conditions was subjected to oxidizing treatment in substantially the same manner as in Example 5. The yarn hanged to slide on the bottom of the heat treatment chamber, causing fuzzing on the yarn. The quality of the resultant oxidized yarn was slightly low. The oxidized yarn was carbonized in substantially the same manner as in Example 5. The tensile strength of the obtained carbon fiber decreased to 250–290 kgf/mm$^2$. However, the carbon fiber was still practicable as a low-grade carbon fiber.

COMPARATIVE EXAMPLE 5

As in example 5, a polyacrylonitrile-based fiber having a total denier of 105,000 was set on flat rollers as shown in FIG. 15, instead of grooved rollers, so that the tension acting on the yarn became $5.7\times10^{-2}$ g/denier as in Example 5. The mean flattening became 80, and the apparent mean denier of the yarn relative to 1 mm in width became 2,600 denier. The yarn in these conditions was subjected to oxidizing treatment at 216° C. A portion of the yarn spread on the surface of a flat roller to tangle with a neighboring yarn, resulting in yarn convolution on the roller. Thus, an oxidized fiber could not be obtained.

COMPARATIVE EXAMPLE 6

In substantially the same conditions as in Example 5, a yarn was set on grooved rollers having generally V-shaped grooves as shown in FIG. 16, which had dimensions: Wa=6.5 mm and Wb=3, and did not satisfy expression (1). The cross-sectional shape of the yarn became a circular shape, and the apparent means denier became 16,000 denier. The initial temperature of the oxidizing treatment of the yarn was set to 210° C. in order to prevent filament breakage and firing due to heat accumulation in the yarn. An oxidizing treatment time as long as 300 minutes was required in order to obtain an oxidized yarn.

Results of Examples 5–7 and Comparative Examples 5, 6 are shown in Table 2 and Table 3.

TABLE 1

| | Area ratio Ss/Sf | Occurrence of Fuzzing site/m | Incidence of convolution times/100 h | Hot gas speed $V_1/V_2$ |
|---|---|---|---|---|
| Example 2 | 1.2 | 1.6 | 0 | 1.01 |
| Example 3 | 1.5 | 1.8 | 0 | 1.02 |
| Example 4 | 2.0 | 2.5 | 1 | 1.05 |
| Comparative Example 2 | 2.5 | 8.1 | 4 | 1.2 |
| Comparative Example 3 | 3.0 | 12.0 | 6 | 1.5 |
| Comparative Example 4 | 4.0 | 15.3 | 9 | 2.1 |

TABLE 2

| | Yarn guide roller | Mean Flattening | Mean denier for 1 mm width (denier) | Tension ($\times 10^{-2}$ g/denier) |
|---|---|---|---|---|
| Example 5 | Grooved | 23 | 4,200 | 5.7 |
| Example 6 | Grooved | 40 | 4,200 | 12.0 |
| Example 7 | Grooved | 13 | 4,200 | 4.3 |
| Comparative Example 5 | Flat | 80 | 2,600 | 5.7 |
| Comparative Example 6 | Grooved | Circular | 16,000 | 5.7 |

TABLE 3

| | Guide roller groove shape, Yarn cross-section shape | Oxidizing treatment time (minute) | Tensile strength of carbon fiber (kgf/mm$^2$) | Quality |
|---|---|---|---|---|
| Example 5 | FIG. 12 | 60 | 380 | ○ |
| Example 6 | FIG. 12 | 60 | 280–300 | Δ |
| Example 7 | FIG. 12 | 60 | 250–290 | Δ |
| Comparative Example 5 | FIG. 13 | — | — | — |
| Comparative Example 6 | FIG. 14 | 300 | 260–300 | Δ |

What is claimed is:

1. A yarn guide roller comprising a yarn guide groove formed on a peripheral surface of the yarn guide roller, the yarn guide groove having a width Wa at a top portion of the groove, a width Wb at a bottom portion of the groove, a depth h of the groove, and a radius R of a roundish bottom corner portion of the groove, which satisfy the following three relational expressions:

$$0.7 \leqq Wb/Wa < 1 \quad \text{(I)}$$

$$0.2 \times Wa \leqq h \leqq 0.4 \times Wa \quad \text{(II)}$$

$$0.2 \times (Wa - Wb) \leqq R \leqq 0.4 \times (Wa - Wb) \quad \text{(III)}$$

the yarn guide roller being disposed outside a furnace body of a fiber heat treatment furnace and guiding a yarn that is being introduced into the furnace body, by the yarn guide groove.

2. A yarn guide roller comprising a yarn guide groove formed on a peripheral surface of the yarn guide roller, the yarn guide groove having a width Wa at a top portion of the groove, a width Wb at a bottom portion of the groove, a depth h of the groove, and a radius R of a roundish bottom corner portion of the groove, which satisfy the following three relational expressions:

$$0.7 \leqq Wb/Wa < 1 \quad \text{(I)}$$

$$0.2 \times Wa \leqq h \leqq 0.4 \times Wa \quad \text{(II)}$$

$$0.2 \times (Wa - Wb) \leqq R \leqq 0.4 \times (Wa - Wb) \quad \text{(III)}.$$

* * * * *

UNITED STATES PATENT AND TRADEMARK OFFICE

CERTIFICATE OF CORRECTION

PATENT NO.: 6,007,465
DATED: December 28, 1999
INVENTOR(S): Kawamura, et al

It is certified that error appears in the above-identified patent and that said Letters Patent is hereby corrected as shown below:

In Column 9, at line 19, please change "chamber" to -chamber 11-.

Signed and Sealed this

Twelfth Day of December, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 6,007,465
DATED : December 28, 1999
INVENTOR(S) : Kawamura, et al

It is certified that error appears in the above-identified patent and that said Letters Patent is hereby corrected as shown below:

In Column 5, at line 54, please change "front" to --font-- .

In Column 9, at line 19, please change "chamber" to –chamber 11–.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*